United States Patent [19]

Utterback et al.

[11] Patent Number: 5,060,890

[45] Date of Patent: Oct. 29, 1991

[54] DETECTION OF OVERHEATED RAILROAD WHEEL AND AXLE COMPONENTS

[75] Inventors: Jeffrey J. Utterback, Harrisonville; Randall S. Mecca, Warrensburg, both of Mo.

[73] Assignee: Harmon Industries, Inc., Blue Springs, Mo.

[21] Appl. No.: 415,103

[22] Filed: Sep. 29, 1989

Related U.S. Application Data

[63] Continuation-in-part of Ser. No. 255,787, Oct. 11, 1988, Pat. No. 4,928,910.

[51] Int. Cl.[5] ..... B61K 9/06

[52] U.S. Cl. ..... 246/169 A; 250/342; 340/682; 340/600; 340/584

[58] Field of Search ..... 246/169 D, 169 A; 250/338.3, 340, 342, 341, 338.1; 340/682, 600, 584

[56] References Cited

U.S. PATENT DOCUMENTS

| | | | |
|---|---|---|---|
| 3,303,340 | 2/1967 | Hewett et al. | 246/169 D |
| 3,545,005 | 12/1970 | Gallagher | 246/169 A |
| 3,733,499 | 5/1973 | Deis et al. | 250/338.3 |
| 4,068,811 | 1/1978 | Caulier | 246/169 A |
| 4,765,413 | 8/1988 | Spector et al. | 250/342 |
| 4,813,003 | 3/1989 | Cox et al. | 250/338.3 |
| 4,928,910 | 5/1990 | Utterback et al. | 246/169 A |

*Primary Examiner*—Matthew C. Graham
*Assistant Examiner*—Mark T. Le
*Attorney, Agent, or Firm*—D. A. N. Chase

[57] ABSTRACT

Overheated railroad journal bearings, wheels, and other wheel components on a moving or stationary railroad train are detected by amplifying the current signal from an infrared radiation sensor comprising a pyroelectric cell. A reference temperature is sensed by chopping the incident infrared radiation with an asynchronous shutter that momentarily closes at successive time spacings of shorter duration than the scanning period of the sensor. The amplified signal is converted to a digital signal and processed by a microcontroller and associated hardware and software. The detector automatically and periodically calibrates itself and compensates the temperature signals for any temperature difference between the ambient external temperature and the temperature inside the detector housing. The output signal may be digital or analog.

8 Claims, 8 Drawing Sheets

DETECTION OF OVERHEATED RAILROAD WHEEL AND AXLE COMPONENTS

CROSS REFERENCE TO RELATED APPLICATION

This application is a continuation in part of application Ser. No. 255,787, filed Oct. 11, 1988, now U.S. Pat. No. 4,928;

BACKGROUND OF THE INVENTION

1. Field of the Invention

The present invention is directed to a method and apparatus for detecting overheated wheel and axle components on railroad cars. More particularly, the present invention is directed to an infrared scanning circuit that employs analog and digital microelectronic circuitry in processing the infrared emitted from such components to determine, in conjunction with ancillary circuitry, whether any individual component is overheated, and, if so, to produce a warning signal that may be transmitted to any of a number of warning read-out devices.

2. The Prior Art

Modern railroad car wheel bearings are permanently lubricated sealed units designed to last for the life of the car. Sometimes, however, these wheel bearings fail during use, causing excess friction between the axle and the bearing and producing excess heat, resulting in a condition referred to as a hot box. Normally, the bearings operate at about 20 degrees centigrade (C.) above the ambient temperature. When a bearing begins running at more than about 70 degrees C. above the ambient temperature, it has already failed. If the car continues moving at the same speed, internal fracture of a roller bearing can cause the bearing to seize, creating thermal run-away. In thermal run-away the bearing temperature rises dramatically from about 20 degrees C. above the ambient temperature to more than 300 degrees C. above the ambient temperature in about one-half mile of travel; under further travel the bearing melts and falls off the axle; the wheels fall off; and the truck falls to the ground, uncoupling the car from those in front of it, triggering the emergency brakes on the whole train and causing the portion of the train behind the disabled car to collapse into an accordion-patterned wreck as the cars leave the tracks.

Brakes that fail to release also produce a dangerous condition that can cause a similar disaster. The affected wheel rises to temperatures on the order of 600 degrees C. and creates a condition known as a hot wheel. If unchecked, the wheel ultimately disintegrates and a derailment results.

Because the hot box and the hot wheel can be so dangerous, the railroad service industry has devoted significant resources to building detectors that automatically check passing trains for hot boxes and/or hot wheels. Such detectors are conventionally spaced along railroad tracks at about twenty to fifty mile intervals along main-line track throughout the United States, and many are necessarily located in remote places. In addition, detectors are continually exposed to and must operate in extremes of heat and cold, wind and rain, and vigorous vibration. Naturally the railroad industry needs highly reliable, low maintenance hot box and hot wheel detectors, preferably at reasonable cost. Although previous efforts have produced several sound products, a number of important problems have not been solved in the prior art.

Detectors in present use typically include a sensing unit lens for focusing infrared from passing wheels onto an infrared sensor and electrical circuitry to develop a signal that is representative of the journal or wheel temperature. One sensing unit is placed along one rail of the tracks and a second sensing unit is placed along the other rail of a set of tracks, so that both sides of a train can be monitored. Electrical lines connect these trackside sensing units to processing circuitry which is conventionally located in a "bungalow" close to the tracks. The final output signal of the detector can be used to create a written record of the temperature of each of the journals or wheels that passes the sensing units. In hot box detectors this signal triggers a warning output if the signal indicates that the temperature of a wheel journal exceeds a predetermined value (generally about 70 degrees C. above the ambient temperature), i.e., if a hot box is detected. The warning output can be used to stimulate any convenient type of warning device. For example, the warning can be displayed on a light board in the cab of the locomotive or in a dispatcher s office, or it can cause a stop signal to be displayed on traffic signals along the tracks.

The prior art includes the commonly used bolometer type of hot box and hot wheel detector. It employs temperature sensitive resistors (thermistors) in a bridge arrangement. Such units also require a highly stable and accurate high voltage supply. Because the signal-to-noise ratio of the bolometer decreases to unacceptable levels even within the normal operating temperature ranges of the detectors, automatic heaters must be installed to keep the thermistors warm enough to work properly. Once heaters are installed, it may become necessary to upgrade the optical system of the bolometer. Thus, overcoming the fundamental problems inherent in a bolometer greatly complicates the device, making it more expensive to build and maintain, and less reliable. In addition, the frequency response of the bolometer is narrower than desired, restricting the top speed a train may be traveling while the bolometer checks for hot boxes or wheels. For a more detailed examination of the shortcomings of bolometers, see U.S. Pat. No. 4,068,811, entitled "Hotbox Detector," issued Jan. 17, 1978.

In an effort to overcome these and other problems, pyroelectric cells were introduced for use as the infrared detection element in hot box and hot wheel detectors. Pyroelectric crystals acquire opposite electrical charges on opposite faces when subjected to a change in temperature. Pyroelectrical cells are also exhibit some piezoelectrical properties, but the incidence of spurious signals generated by vibration have been virtually eliminated through physically isolating the cell from vibration. Pyroelectrical cells overcome many of the difficulties associated with bolometers. For example, hot box detectors built around pyroelectric detection schemes cost only about one-fifth to one-half as much as bolometers. Because the pyroelectric cell generates its own electrical charge, large power supplies are not needed and the high impedance obviates the careful impedance matching of the bolometer. Further, no heaters are required because the signal-to-noise ratio is substantially flat over the required temperature range. Accordingly, simpler and cheaper optical systems can be used. Nevertheless, use of pyroelectric cells confronts the designer with other serious difficulties.

For example, pyroelectric cells tend to have an extremely poor voltage gain response to the impinging infrared, or heat signal, when considered over any reasonable range of signal input frequencies, that is, over a range of train speeds. The voltage gain response tends to depend on the length of time that the pyroelectric cell is exposed to the infrared, as well as the strength of the infrared. Thus, a typical infrared sensor employing a pyroelectric cell has an acceptably flat or constant voltage gain response over only about two percent of the frequency range required for acceptable hot detector operation, which is about 0.5 Hz to about 300 Hz. This prevents accurate temperature readings when a linear amplifier is used, yet only the voltage gain has a sufficiently high signal-to-noise ratio to provide a usable signal.

One prior art approach to overcoming this difficulty is to add a compensating signal to the pyroelectric cell signal to produce a signal having a flat frequency response over the normal range of frequencies, as set forth in the aforementioned U.S. Pat. No. 4,068,811. Over time, however, the breakpoint at which the voltage response of the pyroelectric cell begins to decline sharply drifts unpredictably due to changes in capacitance and response time. It may drift up or down the frequency scale; it may drift by different amounts. Neither the magnitude nor the direction of the drift will be the same for different detectors. The circuitry that develops the compensating signal cannot compensate for this drift, and so the detector will not produce the flat voltage response over the relevant frequency range that the remaining circuitry must have for proper operation. This long term signal drift requires frequent calibration checks of the pyroelectric cell. Such checks, and if necessary, re-calibration, are extremely difficult to perform accurately in the field and often require taking the unit to the shop. Even with frequent servicing, such units are often out of calibration and the resulting calibration errors lead to further reporting errors and increased service costs.

Another difficulty is created by the physical characteristics of pyroelectric crystals—namely that they produce an electrical potential only in response to changes in temperature. This characteristic requires that the infrared detector, that is, the pyroelectric cell, be subjected to changes in the amount of infrared striking it. In addition, the normal operating temperature of a railroad wheel bearing is determined relative to the ambient temperature. The requirement of measuring both the wheel bearing temperature and the ambient temperature provides a ready made opportunity to expose the pyroelectric cell to the required changes in the infrared heat signal. Difficulties arise, however, in choosing a suitable infrared source to determine the ambient temperature.

Some pyroelectric hot box detectors in the prior art approach this problem by merely leaving the detector turned on whenever a train is passing and aiming the lens so that it receives infrared from passing bearings, and from the undercarriage of the railroad cars. This passive-read system assumes that the temperature reading developed from looking at the undercarriage is the ambient temperature, and compares this to the temperature of the bearing. This solution works well if the undercarriage is actually at ambient temperature, but if, for example, the undercarriage is on fire (which not infrequently occurs from faulty brakes), such a detector will see the heat from the fire as the ambient temperature and will be unable to detect any problem with a bearing, or even to detect the fire itself. Less dramatically, the sensor may measure the heat from a spurious source, such as brakes, and, unable to distinguish between hot brakes and hot bearings, issue a hot box warning. Then the crew must stop the train, and walk the train searching for a non-existent over-heated bearing.

Another problem for passive-read systems is presented by the increased used of railroad spine cars, which are a skeleton steel-rail flatbed with trucks attached. Spine cars are used to haul semi-trailers piggyback. When a passive-read hot box detector looks at the undercarriage of spine cars, it is likely to take a "sky shot," and read only infrared from the distant sky as ambient. A sky shot temperature reading is usually about 20 degrees C. to 30 degrees C. less than actual ambient temperature. Naturally, this leads to many false warnings, since a bearing at normal operating temperature would show up as 40 degrees C. to 50 degrees C. hotter than the ambient temperature. Again, the crew must stop the train and walk the train searching for a non-existent hot box.

One prior art approach to overcoming this difficulty is to include a shutter that covers the lens at all times except when the apparatus expects to see a wheel bearing. This practice screens out all spurious infrared from overheated brakes and the like, and takes for its ambient temperature reading the temperature of the shutter blade inside the detector housing. The detector, however, warms up and cools down more slowly than the true ambient temperature, especially during periods of rapid ambient temperature changes. These changes predictably occur around sunrise and sunset, and unpredictably occur during weather changes and in magnitudes that depend on the season and the weather. The temperature inside the detector housing tends to lag the actual ambient temperature by about two hours. This temperature lag can cause the measured difference between the correct ambient temperature and the journal bearing temperature to be wrong by as much as 10 degrees C. In addition, sun loading can heat the detector unit to a temperature that is considerably hotter than the ambient temperature. These differences between internal detector temperature and the actual ambient temperature can obviously lead to erroneous comparisons between ambient temperature and bearing temperature, creating both false negatives and false positives.

In addition, the prior art shutter detection scheme requires synchronization between the opening and closing of the shutter and the passing of the bearings, i.e. the shutter must be open when a wheel is being scanned, and closed when no wheel is being scanned. This necessitates rapidly starting and stopping the shutter. The shutter is operated by an electric solenoid. The ancillary devices required to synchronize the movement of the shutter with the passing train wheels are complex and expensive. Repeatedly energizing the shutter solenoid wears out the solenoid quickly, and the jolt caused by stopping the shutter sometimes creates spurious signals from the pyroelectric cell due to its piezoelectric characteristics. Accordingly, although use of a synchronized shutter to screen unwanted infrared from the pyroelectric cell avoids the temperature sensing problems of the passive-read system, it leads to complex problems of its own.

Furthermore, prior art hot box and hot wheel detectors transmit an analog output signal. Analog signals are naturally more prone to degradation, distortion, and attenuation than digital signals, and typically can carry far less information. Increasingly, remote signalling devices and other ancillary equipment accept digital signals, which not only may convey more information, but do so more accurately than analog signals.

Therefore, a need exists for hot box and hot wheel detectors that are less expensive to manufacture, maintain, and operate; that are more reliable; that reduce or eliminate false negative warnings and false positive warnings, both of which are inordinately expensive; that produce consistent operating results over time by eliminating the effect of pyroelectric cell drift; that can generate either a digital or analog output signal, allowing the user railroad to use analog ancillary devices for their full useful life if desired, and then conveniently change to more modern digital ancillary devices; and that reliably measure ambient temperature notwithstanding spurious undercarriage or detector housing temperatures.

SUMMARY OF THE INVENTION

Accordingly, it is an object of the present invention to provide a detector for hot box or hot wheel applications that is less expensive to manufacture, maintain, and operate.

It is another object of the present invention to provide an infrared scanning circuit which uses an asynchronous shutter that rotates continuously when a train is present, eliminating the need to synchronize the shutter with the passing train wheels and reducing excessive wear on the shutter motor.

It is another object of the present invention to provide an infrared scanning circuit that uses a pyroelectric cell for detection of infrared, but measures current responsivity to thereby utilize a signal that is essentially the same for a bearing or wheel of a given temperature regardless of the speed of the train.

It is another object of the present invention to provide an infrared scanning circuit that generates either a digital or analog final output signal.

It is another object of the present invention to provide an infrared scanning circuit that is more reliable.

It is another object of the present invention to provide an infrared scanning circuit that reduces or eliminates false negative warnings and false positive warnings.

It is another object of the present invention to provide an infrared scanning circuit that reliably measures the ambient temperature notwithstanding non-ambient undercarriage temperatures.

It is another object of the present invention to provide an infrared scanning circuit that can determine the temperature of a journal bearing or a hot wheel regardless of the speed of the train.

It is another object of the present invention to provide an infrared scanning circuit that automatically calibrates itself at regular intervals through use of a closed loop calibration check, thereby eliminating the effect of pyroelectric cell signal drift caused by the passage of time and by temperature changes.

It is another object of the present invention to provide an infrared scanning circuit detector that automatically compensates for any difference between the ambient outdoor temperature and the temperature inside the detector housing.

These and other objects are achieved by providing an infrared scanning circuit comprising a lens that focuses incident infrared onto a pyroelectric cell, which is electrically connected to a current driven preamplifier (preamp) that further develops the signal generated by the pyroelectric cell in response to temperature changes induced by changing amounts of infrared striking it. The infrared scanning circuit includes an asynchronous rotating shutter that screens the pyroelectric cell from extraneous infrared to provide a reference ambient temperature reading, but is not synchronized with the passage of the train wheels in front of the lens. Use of the asynchronous rotating shutter allows the infrared scanning circuit to effectively monitor bearing or wheel temperature even when the train is moving slowly or is stationary.

The analog preamp output signal drives a digital gain control which outputs a signal to a microprocessor or microcontroller, as the designer may select, and all further signal processing is digital until the final output, which may be either digital or analog as the end user chooses. The infrared scanning circuit for a hot box or hot wheel detector includes suitable circuitry and computer software and firmware for automatically and frequently checking the integrity of the circuitry and software.

A calibration heat source (an infrared light emitting diode (LED)) is excited twice at different power levels, shining two infrared signals onto the pyroelectric cell at two different energy levels. The resulting pyroelectric cell signals are used to calibrate the infrared scanning circuit. The calibration system includes hardware and software described in detail below. This automatic calibration system is invoked as part of the integrity test, which is performed continuously when no train is present in the wheel gates.

To overcome the effects of temperature lag in the housing, the infrared scanning circuit includes an automatic temperature compensation system, consisting of hardware and software, to automatically correct output temperature signals for the differences between the temperature within the housing and the outside ambient temperature.

The achievement of these and other objects of the invention will become apparent upon consideration of the detailed description of a preferred embodiment, taken in conjunction with the drawings.

DETAILED DESCRIPTION OF THE PREFERRED EMBODIMENT

This description generally will first discuss the schematic flow of information in the system, then the asynchronous shutter, then the preamplifier and the signals it generates, then the mechanical characteristics of the apparatus, and finally, the computer programs, or software, that operate the system.

THE SCHEMATIC OF THE SYSTEM

Figures 1, 2:
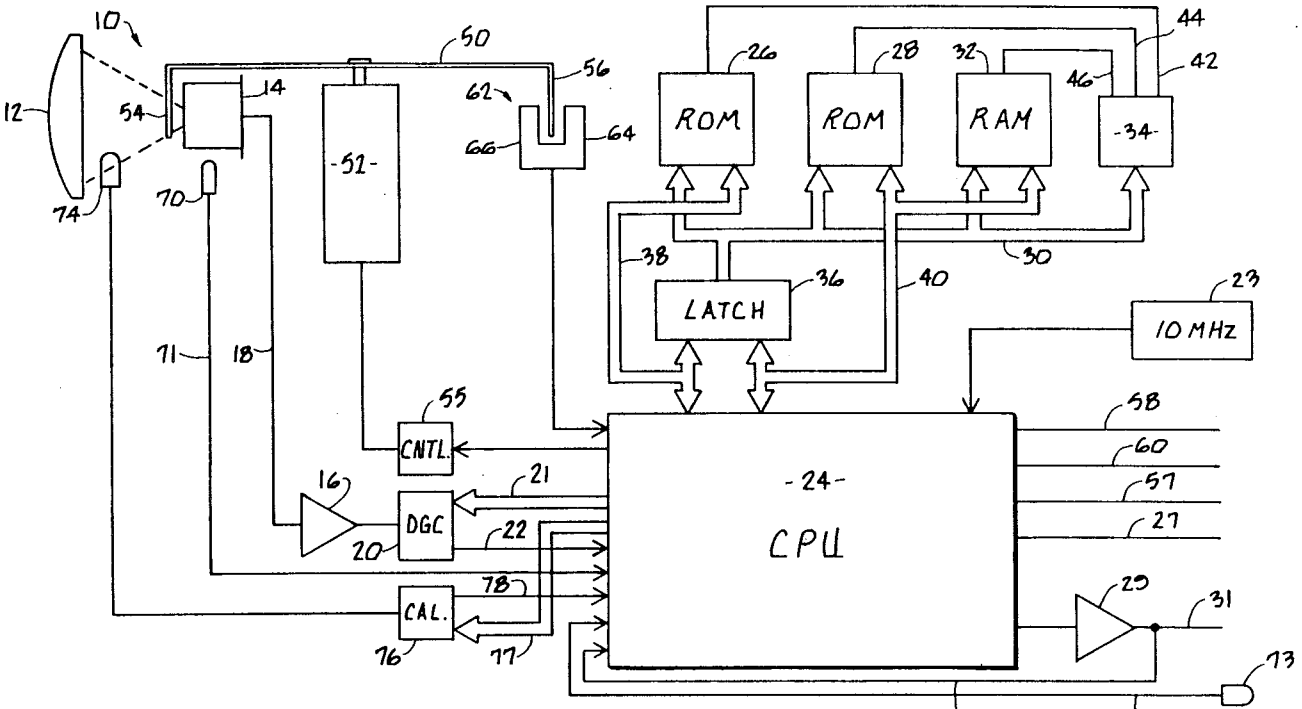
FIG. 1 is a schematic of an infrared scanning circuit according to the present invention, illustrating the mechanical elements diagrammatically together with a block diagram of the electrical elements of the invention.
FIG. 2 is an electrical schematic diagram of the pyroelectric cell and related preamplifier of the preferred embodiment of the present invention.

Referring to FIG. 1, there is shown generally an apparatus for detecting overheated railroad journal bearings, sensing unit or detector 10, having a focusing means such as lens 12 for focusing impinging infrared onto pyroelectric cell 14 or other suitable infrared sensing unit or sensor. Lens 12 is conventionally a germanium lens that focuses and transmits only the far infrared portion of the spectrum. Pyroelectric cell 14, conventionally made from $LiTaO_3$, converts the impinging infrared to an analog electrical current having a magnitude that is directly proportional to the temperature of the object emitting the infrared radiation.

Preamplifier 16 amplifies the current component of the signal transmitted on line 18, thereby measuring the current response of pyroelectric cell 14 to changes in the amount of infrared striking it. Preamplifier 16 also changes the analog current signal from pyroelectric cell 14 to an analog voltage The output signal of preamplifier 16 exhibits a linear response to frequencies from 0.06 Hz to 200 Hz, where "frequency," when discussing the responsiveness of the circuitry to the bearing temperatures in a passing train, is defined as the number of times per second that a space between train wheel sets passes the detector. This frequency detection range corresponds to train speeds in the range of 5 miles per hour to 150 miles per hour (absent the asynchronous shutter to be discussed). The distance between wheel sets is not constant throughout the train since wheel sets are not evenly spaced.

Figure 3A:
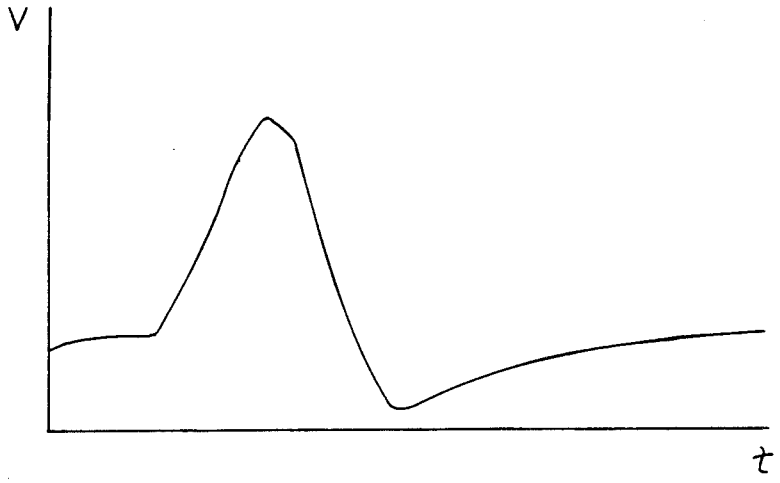
FIGS. 3A, 3B and 3C are graphs illustrating wave forms generated by the circuitry when an overheated journal bearing is detected. Time is displayed o the horizontal axis and temperature is displayed on the vertical axis.
Figure 3B:
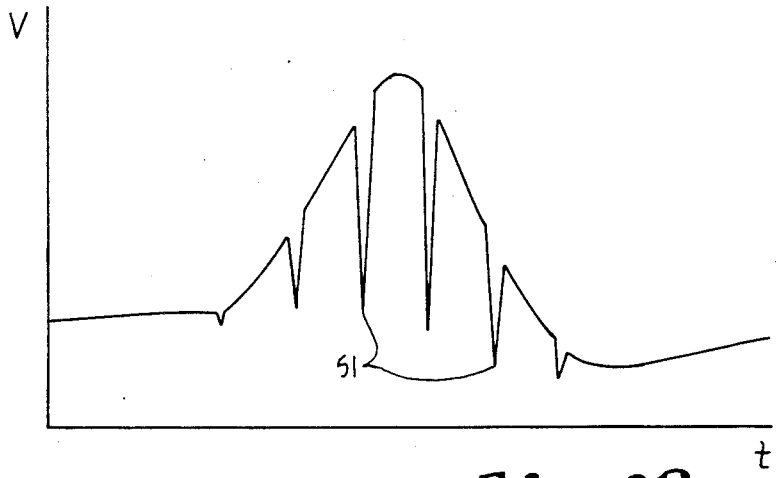

FIGS. 3A and 3B illustrate graphically the output signal from preamp 16 in response to a heat source. In all three graphs, time is displayed on the horizontal axis and voltage is displayed on the vertical axis. The voltage is directly proportional to temperature. Both the time and voltage scales are linear.

Figure 3C:
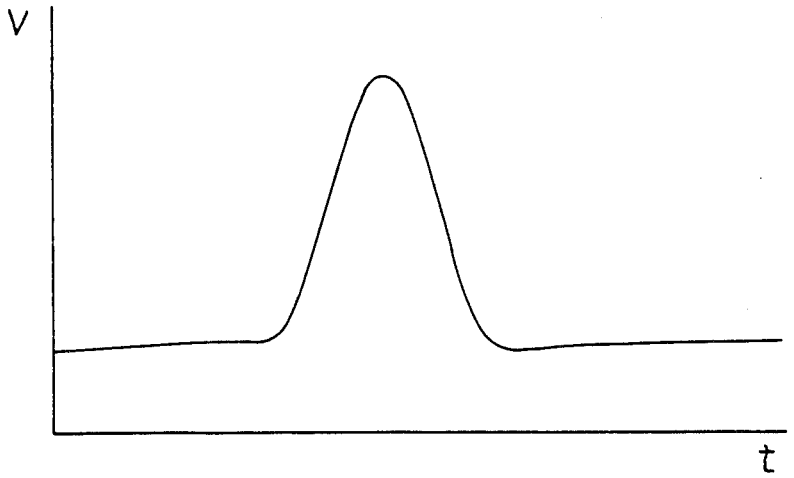

FIG. 3A illustrates the response of preamp 16 to a heat source when a passive-read sensor is used, and the ambient temperature is read from whatever background object passes lens 12. FIG. 3A shows the response to a low frequency (slow moving) heat source with a 3 db thermal degradation. FIG. 3B shows the response to the same heat source when a chop frequency overlay is used to create a reference temperature reading. The chop, or modulation, is created by an asynchronous shutter, as discussed in detail below. FIG. 3C shows the reconstructed analog heat signal of FIG. 3B after processing by microcontroller 24.

Referring again to FIG. 1, the analog voltage output signal from preamplifier 16 is fed to digital gain control 20. The digital gain control 20 is an operational amplifier (hereinafter "opamp") whose gain is controlled by a digital feedback loop and whose output is an analog signal. Digital gain control 20 is an electrically erasable potentiometer (hereinafter "EE pot"), which is an Xicor X9103 in the preferred embodiment. Using the EE pot for digital gain control 20 allows microcontroller (CPU) 24, under software command, to fine-tune the gain continuously, thereby eliminating the need for a technician to service the gain control. It is intended that the EE pot be adjusted only during factory calibration, and not in the field.

The analog signal from digital gain control 20 is transmitted via line 22 to microcontroller 24, which includes an internal analog to digital converter (A/D converter) (not shown separately), which converts the analog signal to a digital signal immediately. All further signal processing and all instructions are preformed digitally. The final output signal is produced by and transmitted from microcontroller 24. The final output signal may be a digital signal appearing on lead set 27. Alternatively, the final output may be taken from digital to analog converter (D/A converter) 29 via analog output line 31 from microcontroller 24, and is shown in FIG. 3C. In either case, the final output is transmitted to remotely located hot box detector circuitry for further processing. Feedback loop 35 from the output of D/A converter 29 to microcontroller 24 monitors the gain in D/A converter 29.

Microcontroller 24 is an Intel 8097BH which comprises a 16-bit microcontroller including all circuits required for fetching, interpreting, and executing instructions that are stored in memory, whether volatile or nonvolatile. Microcontroller (CPU) 24 further includes a program counter, an instruction decoder, an arithmetic logic unit, and accumulators. An external 10 MHz crystal oscillator 23 pulses a clock pulse generating circuit (not shown) inside microcontroller 24 to generate 10 MHz clock pulses, which control all circuit timing functions.

Computer programs, or software, are stored in memory storage units. A suitable memory storage unit used in the preferred embodiment is an electrically erasable programmable read only memory (hereinafter "EEPROM") such as an Xicor 28C64, which is an 8-bit memory device. EEPROMs were chosen to facilitate reprogramming that may be desirable during maintenance in the shop. It is not intended that the content of these memory devices will be altered in the field. Clearly, different types of memory units could be chosen, such as simple read only memory (ROM), or programmable read only memory (PROM), or, if the ability to reprogram the ROM is desirable, erasable programmable read only memory (EPROM), which are conventionally erased by exposure to ultraviolet light. Currently, EEPROMs are not commercially available in 16-bit widths, so the present invention uses two 8-bit EEPROMs operating in concert to provide the 16-bit architecture that allows microcontroller 24 to operate efficiently.

EEPROM 26 contains high byte instructions, that is, the most significant eight digits of the 16-bit instruction set, and EEPROM 28 contains the low byte instructions, that is, the least significant eight bits of each instruction. EEPROMs 26, 28 are of the type commonly referred to as 8K×8 devices and have a capacity of essentially 8,000 bits in an 8-bit package.

Address bus 30 provides a unidirectional address path from address latch 36 to EEPROM 26, EEPROM 28, random access memory (RAM) 32, and address decoder and memory protection unit 34.

Data bus 38 connects EEPROM 26 with address latch 36 and microcontroller 24 to provide a bidirectional data path to carry upper order data. Data bus 40 provides a bidirectional data path between address latch 36, EEPROM 28, and RAM 32 to carry lower order data. Operating in concert, data bus 38 and data bus 40 allow EEPROMs 26, 28 to provide microcontroller 24 with a 16-bit signal width. Conventional control lines 42, 44, 46 from unit 34 are used to select the integrated circuit chip that will be used to process a specific signal, and to read from the PROMs and to read from and write to RAM 32.

THE ASYNCHRONOUS SHUTTER

The present invention employs a rotating shutter 50 which passes between lens 12 and pyroelectric cell 14 to periodically block external sources of infrared from pyroelectric cell 14. During operation, shutter 50 closes to block external infrared about ten percent of the time and allows external infrared to strike pyroelectric cell 14 about ninety percent of the time, that is, shutter 50 provides a duty cycle of ninety percent on and ten percent off. When shutter 50 is closed, the infrared signal is chopped, or modulated, to the ambient temperature inside the housing 110 of detector 10, ensuring a difference between an external heat source and the reference signal (internal housing ambient temperature), as illustrated in FIG. 3B. Shutter 50 comprises an arm with downturned ends presenting two depending shutter blades 54, 56 spaced 180 degrees apart, so that shutter 50 presents a closed condition or closed shutter state to pyroelectric cell 14 twice during each revolution of shutter 50. The radial length of the shutter arm from its axis of rotation to each blade 54 or 56 is 1.06 inches (2.7 cm.). In one preferred embodiment, the heat signal read by the pyroelectric cell 14 and associated circuitry is used as to develop a reference temperature for comparing with the wheel component temperature. In another preferred embodiment (the automatic self-compensating and self-calibrating embodiment) involving different hardware and software that are discussed below in detail, the heat signal impinging on pyroelectric cell 14 during the shutter-closed time spacing, or state, is used to modulate the wheel component heat signal that the pyroelectric cell 14 must experience to develop a signal.

It is desirable that pyroelectric cell 14 be instantaneously exposed to the shutter when the shutter 50 closes so that the entire period of a closed shutter state represents the reference temperature. In operation, however, the change from an external temperature source to the internal reference is not instantaneous, and the resulting chop of the incoming infrared heat signal is not a straight drop to the reference temperature, as, for example, a square wave would be. This characteristic requires certain adjustments in the sampling rates microcontroller 24 uses to generate temperature readings, as described in detail below.

Shutter 50 is rotated by shutter motor 52, which is a brushless military-grade direct current electric motor having stainless steel ball bearings and which is highly shock resistant. Shutter motor 52 is driven by pulsed direct current from motor controller 55 whose output is controlled by microcontroller 24 and associated software, which control a field effect transistor (FET) (not shown separately). The frequency of the closed shutter 50 condition, or chop rate, is preferably 150 Hz (shutter rotation of 75 revolutions per second, or 4,500 revolutions per minute), which is approximately twice the 82 Hz modulation frequency of train wheel sets passing the detector at 150 miles per hour. This chop rate ensures that the closed shutter condition will not block more than about one and one-half inches of the circumference of a journal bearing from view by lens 12 even if the train is traveling 150 miles per hour. At this speed, the heat sample (a journal bearing) is within the scanning zone for only three to four milliseconds. With a 45 degree scan angle by lens 12 and pyroelectric cell 14 relative to a journal, the detector can scan 180 degrees of the journal bearing over a distance of about 14 linear inches (33 cm.). A chop frequency that chops only one and one-half inches from this fourteen inch scan at a train speed of 150 miles per hour provides an excellent reading of the journal bearing temperature, while also providing a valid reference temperature.

A conventional wheel transducer (advance transducer) on the track (not shown) connected to microcontroller 24 via line 57 is located 150 feet or more ahead of a pair of spaced wheel transducers that define the beginning and the end of a scanning zone through which the circuitry is receptive to infrared radiated from the passing train. Such transducers are conventionally utilized in hot box and hot wheel detectors, with the transducer pair defining the scanning zone (referred to hereinafter as the gate on and gate off transducers respectively) typically being spaced apart longitudinally along the rails a distance of about 17 inches (43 cm.). The length of time that the wheel component to be scanned is in the scanning zone will be referred to as the scanning period. The scanning period will be a different length of time for different sized wheel components and for different train speeds. Accordingly, the advance transducer transmits a signal to microcontroller 24 via line 57 when a train wheel passes over it. This signal is used to turn on shutter motor 52 and to prepare the circuitry for the subsequent processing of heat signals once the wheel trips the gate on transducer and enters the scanning zone. Software routines (primarily the Train Pass routine) keep shutter 50 in the on state until the entire train has passed. The Train Pass routine basically includes a timer that times out and shuts off shutter motor 52 if no more train wheels enter the scanning zone. Naturally, if a train merely stops for a time, shutter motor 52 will stop and the sensing unit will not output heat signals, but the unit will immediately start again when the train resumes travel.

A wheel gate signal on line 58 from the gate on transducer causes microcontroller 24 to generate a final output on lead set 27 or 31 that is representative of the temperatures of the journal bearings scanned. This final output results from sampling the input signal to microcontroller 24 from digital gain control 20 via line 22 at a sampling rate of about 3,000 Hz while shutter 50 is open and about 25,000 Hz when shutter 50 is closed. These sampling rates are empirically determined and should be at least twice the maximum input frequency. The sampling rate is increased for the shutter-closed state (or time spacing state) because this shutter-closed state or shutter-closed period causes a nearly sinusoidal transient signal, rather than the idealized square wave drop from the external temperature to the shutter temperature. The amplitude heat signal is directly proportional to the temperature of the scanned object, i.e., the heat signal from a hot wheel component has a greater amplitude than the heat signal from a colder shutter. The amplitudes of these two heat signals are compared by the software to provide an indication of the difference between the wheel component temperature and the outdoor ambient temperature. The later embodiment permits automatic compensation for the difference between the internal temperature of housing 110 and the external ambient temperature. The software chooses the lowest sampled value (i.e., the smallest amplitude heat signal) to calculate the temperature in the shutter-closed position. Sampling frequently increases the probability of getting a more accurate shutter temperature reading.

When the train wheel leaves the scanning zone, a wheel gate signal from the gate off transducer (not shown) is transmitted via line 60 to microcontroller 24. This gate off signal indicates that the train wheel has passed through the wheel gate transducers defining the scanning zone, and causes microcontroller 24 to stop generating an output signal since no further information is available from the wheel that has passed out of the zone.

While the train wheel is between the wheel gate transducers, its temperature is scanned by the detector. During this scanning time, shutter 50 chops the signal to provide a reference signal as shown in FIG. 3B by the regularly spaced notches 51 in the output signal from preamp 16. To prevent the low heat signal generated during the shutter-closed state from being transmitted as a journal bearing temperature, optical switch 62 is provided. When shutter blade 54 blocks pyroelectric cell 14 from infrared, shutter blade 56 blocks optical switch 62, comprising light emitting diode (LED) 64 and phototransistor 66. Shutter blade 56 interrupts the output signal of optical switch 62, which via line 68, informs microcontroller 24 that shutter 50 is closed, a reference temperature is being taken, and not a bearing temperature. Microcontroller 24 then continues to output the latest sample taken prior to the closed shutter state, until the wheel leaves the scanning zone.

The output from optical switch 62 is also used to measure the revolutions per unit time of shutter 50. This information may be used to control the speed of shutter motor 52. If, for example, shutter 50 is rotating too slowly for a given train speed, not enough of the bearing will be scanned to provide an accurate temperature reading, and the shutter rotation must be increased. If, on the other hand, shutter 50 is rotating too rapidly, the reference temperature generated by the signal chopping action of the shutter may not be accurate, and the shutter must be slowed. This is easily accomplished through software controls operating in concert with microcontroller 24, which act on motor control 55, which in turn increase or decrease the shutter speed. However, speed control of the shutter is not required in most applications. It is sufficient to allow shutter 50 to rotate at the maximum speed of electric motor 52, that is, about 4,500 rpm.

In the automatic self-compensating and self-calibrating embodiment, an infrared light emitting diode 74 is pulsed, providing an infrared signal to pyroelectric cell 14. The infrared from LED 74 emits energy in the range of about 940 nanometers, which is within the detection range of the pyroelectric cell 14. The power output of LED 74 drifts over time and therefore would not provide an absolute and reliable amount of energy for stimulating pyroelectric cell 14, which would cause errors in temperature reading that would exceed those of the prior art. Therefore, the LED 74 is pulsed to known different energy levels through calibration control 76, which is connected to microcontroller 24 by line 78 and which receives signals from microcontroller 24 through unidirectional address bus 77. This output difference or delta remains essentially constant over time and temperature, allowing the apparatus 10 to calibrate the output from digital gain control 20. When the LED 74 is pulsed, it produces infrared radiation that strikes pyroelectric cell 14, is amplified in preamplifier 16, and is sent to digital gain control 20 which produces a signal on line 22 for further processing by microcontroller 24. Digital gain control 20 receives information from microcontroller 24 via unidirectional address bus 21. If the voltage level received by microcontroller 24 from the digital gain control 20 exceeds the preset high, or falls below the preset low voltage warning limits, microcontroller 24 adjusts the gain and issues an integrity warning. At the same time, microcontroller 24 mathematically adjusts the gain so that the output signal of digital gain control 20 is within original specifications.

The automatic calibration circuitry described in the preceding paragraph is controlled by software routines that are invoked during the integrity test. Detailed discussions of the specific automatic calibration software routine is found in connection with the discussion of FIG. 13.

Automatic compensation for the difference between the temperature inside the housing 110 and the external ambient temperature is provided by another hardware and software system. Hardware components include internal temperature sensor 70, which is connected directly to microcontroller 24 by line 71. Line 72 is connected to a remote external temperature sensor 73 for measuring the ambient temperature. The signal on line 72 also is fed directly into microcontroller 24. Typically, the external temperature sensor 73 is placed in a location that the railroad company feels will provide the best remote ambient temperature reading during all normal operating conditions. It may be placed along the track (at trackside), in the equipment shed, and so forth. The external sensor provides a reading of a true ambient temperature which is compared to the wheel component temperature measured by pyroelectric cell 14 and associated hardware and software. Pyroelectric cell 14, however, needs to be exposed to a change in infrared to generate a voltage. This change is created by the use of a rotating reference shutter 50. When the shutter 50 blocks external infrared from pyroelectric cell 14, the heat impinging on pyroelectric cell 14 is naturally different from the amount of heat that would otherwise be focused on pyroelectric cell 14 by the lens 12.

Figure 14:
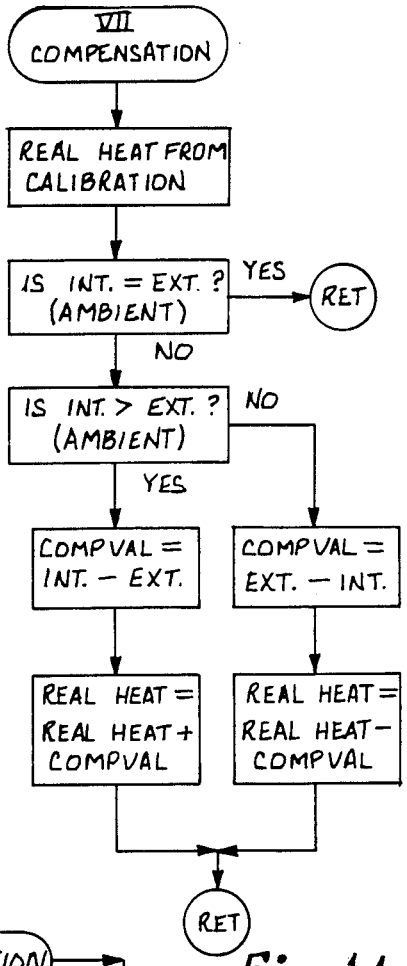

The signal generated by pyroelectric cell 14 then will depend on the temperature difference between the external heat source seen through lens 12 and the heat signal impinging on it when the shutter 50 is between pyroelectric cell 14 and lens 12. If accurate readings of railroad undercarriages are to be obtained, some compensation must be made for the difference between the temperature inside the housing 110 and the exterior ambient temperature. The internal temperature of housing 110 may be greater than the ambient temperature due to sun loading, waste heat from the apparatus, and other factors discussed above. In addition, the apparatus 10 will be seated in an electrically-heated cradle in many cold weather locations to prevent snow from building up on the apparatus and obscuring lens 12. In other conditions, the temperature inside housing 110 may be significantly lower than the outside temperature. The software required to automatically compensate for the difference between the housing 110 temperature and the ambient temperature is discussed below in reference to FIG. 14.

THE PREAMPLIFIER

Referring to FIG. 2, there is shown a schematic diagram of preamplifier 16 comprising a two-stage analog amplifier. Stage one responds to the current responsivity of the cell 14 and comprises a monolithic electrometer operational amplifier (opamp) 80, and a T-network feedback loop including resistor 82, resistor 84, and resistor 86 and associated components and power inputs. Opamp 80 is a field effect transistor (FET) integrated circuit such as a Burr-Brown OPA128, designed for measuring and amplifying extremely low currents. Together with the T-network feedback loop, opamp 80 converts the analog input current signal from pyroelectric cell 14 to an analog voltage output signal on lead 88.

The current output from pyroelectric cell 14 is extremely small usually less than 100 picoampere and the signal-to-noise ratio is very low. Accordingly, a gain of more than 100 million times the input signal is required of the stage one amplifier. FET opamp 80 and the T-network feedback meet these requirements.

FET opamp 80 has an input bias current specification of ±75 fA and thereby reduces the errors from input bias current. The T-network feedback eliminates the impedance problems that could be caused by moisture and other contaminates that find their way into the detector housing in the field. The T-network feedback loop allows the use of lower value resistors to produce the same effect as a much higher feedback resistance.

A conventional low current amplifier configuration would employ a single high value resistor in a feedback loop. Such circuits require a resistor of about 1 to 10 Gohms. When such a large resistor is used, its resistance combines with the capacitance of the printed circuit board itself to cause distortions in the frequency response of the pyroelectric cell. Namely, the current response becomes non-linear and drops sharply at an input frequency that is too low for monitoring moving train journal bearings. Use of the T-network feedback loop eliminates this problem, as discussed immediately below.

The network of resistors 82, 84, 86 has a short-circuit transfer impedance that makes it equivalent to a feedback resistance of:

$$R_f = R82 + R86 + \frac{R82 \times R86}{R84}$$

An effect of this function is that a high input resistance and a high gain can be achieved without high-level feedback resistors. The T-network feedback loop allows the circuit to have high frequency response with high gain. These characteristics permit highly accurate measurements of transient infrared signals, such as those presented to pyroelectric cell 14 during a closed shutter state. Operating in conjunction with the filter and smooth software routine (see below), it also achieves a good signal-to-noise ratio that may have been lost during initial signal processing.

Capacitor 90 and capacitor 92 provide high frequency filtering and are matched to the capacitance of the feedback network and the load capacitance. The load capacitance presented by pyroelectric cell 14 ranges from about 10 picofarads to about 20 picofarads (pF), depending on manufacturer and lot. The impedance of a pyroelectric cell is about $10 \times 10^{13}$ ohms By selecting the appropriate values for resistors 82, 84, and 86, the gain from opamp 80 can be maximized up to the desired maximum train speed, or frequency. In choosing the values of resistors 82, 84, and 86, and the values of capacitors 90 and 92, the capacitance of the resistor-capacitor circuit formed by the load capacitance, resistor 82 and resistor 84 should be taken into account in accordance with well known mathematical relationships that describe such networks.

All specific values for resistors and capacitors provided herein were derived for use in a system tuned for a specific pyroelectric cell, the Eltec S400M8-8, and may not be exactly appropriate for others. With this caveat, examples are as follows: resistor 82 is 47 megohms, resistor 84 is 1,000 ohms, and resistor 86 is 20,000 ohms; capacitor 90 is about 0.75 pF and capacitor 92 is about 1,000 pF. This T-network provides an effective resistance of about $9.45 \times 10^9$ ohms.

The second stage amplifier of preamp 16 consists of analog operational amplifier (opamp) 94, preferably an integrated circuit amplifier such as a generic OP-77 operated as a non-inverting voltage mode amplifier, with associated resistance-capacitance (RC) feedback and power inputs. Capacitor 95 is 30 pF and resistor 97 is 560,000 ohms, and they are grounded through 10,000 ohm resistor 102. Opamp 94 amplifies the voltage signal from opamp 80 and transmits a suitable analog output to microcontroller 24 via line 96. The signal is now strong enough and clean enough for the A/D converter within microcontroller 24 to accurately determine the temperature of objects scanned by pyroelectric cell 14.

Guard trace 104 (shown in broken lines in FIG. 2) provides circuit protection against high impedance shorts that might result from foreign objects contaminating the printed circuit board in the field and causing noise interference. With guard trace 104 in place, a contaminating resistance of less than forty megohms would be required to affect circuit performance. Ground connection 106 provides a ground for the positive side of pyroelectric cell 14 and the non-inverting input of opamp 80.

Preamp 16 and pyroelectric cell 14, as described, are capable of a response time, i.e., the period from impingement of infrared on pyroelectric cell 14 to an equilibrium output signal on lead 96, of about 300 microseconds to about 500 microseconds. The response time achieved by the detector is more than adequate to measure journal bearing or wheel temperature accurately on even the fastest trains.

THE MECHANICAL STRUCTURE

Figure 5:
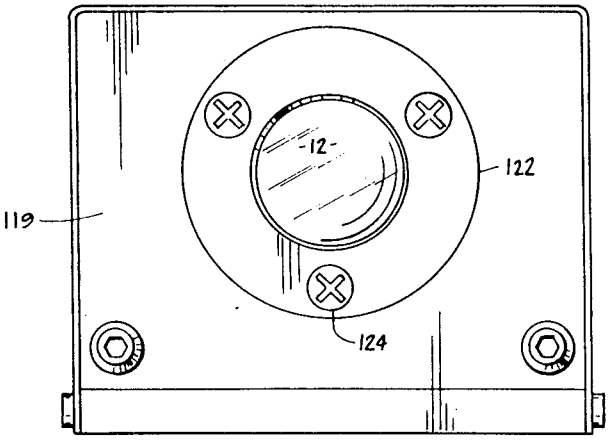
FIG. 5 is a front elevation of the housing shown in FIG. 4, taken along line 5—5 of FIG. 4.
Figure 4:
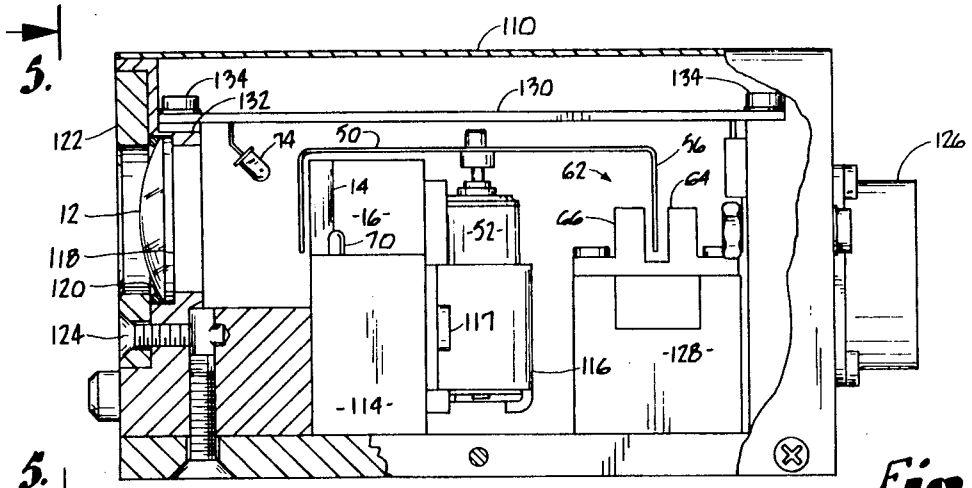
FIG. 4 is a side elevation, partially in section, of the infrared scanning circuit and related hardware enclosed in a housing.
Figure 6:
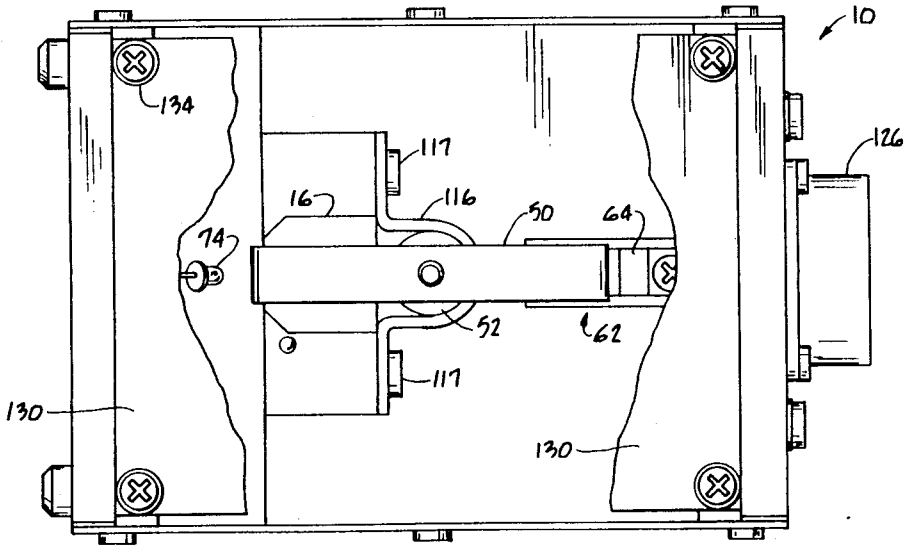
FIG. 6 is a plan view of the infrared scanning circuit housing and interior components, with the top and underlying circuit board partially cut away.

Referring to FIGS. 4–6, there is shown the detector 10 self-contained in housing 110 except for an external power supply (not shown), leads from the wheel transducers, and signal transmission lines (not shown) that conduct the output signal to the remote hot box detector processing circuitry. These lines run through bayonet type connector 126 connected to the back of housing 110. Shutter 50, shown in the shutter-closed state, is fixed to drive shaft 112 of shutter motor 52, which is secured to a mounting block 114 by motor clamp 116 and fasteners 117. Pyroelectric cell 14, and preamp 16, which are electrically connected to one another, are mounted on the top of block 114 and are disposed behind and in alignment with depending shutter blade 54 and germanium lens 12.

Lens 12 is seated in a recess 118 in the front wall 119 of housing 110 and sealed by O-ring 120, and is clamped into recess 118 by collar 122 secured to wall 119 by fasteners 124. The optical switch 62 is mounted on top of a support 128, and consists of light emitting diode 64 and phototransistor 66 spaced apart and, as shown in FIG. 4, separated by depending shutter blade 56.

Mother board, or primary printed circuit board, 130 is horizontally disposed in the upper portion of housing 110, and includes essentially all electrical components except preamp 16. Mother board 130 is fastened to landings 132 by fasteners 134.

THE SOFTWARE

The primary program, or Main Program, includes a few initialization routines, and three separate important routines, which can be interrupted at any point during execution to service any one of several interrupts. All other software routines are interrupts of one type or another, which are self-activated as required. The discussion of the software is presented in outline form and the subroutines in the FIGS. are labeled with the outline numbers.

Figure 7:
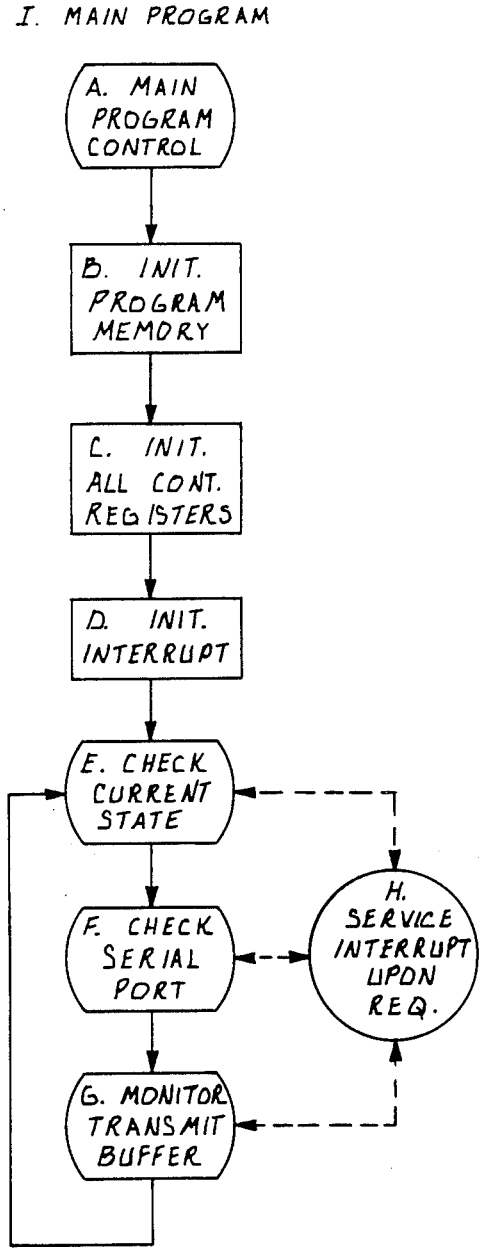
FIGS. 7, 8*a*–8*f*, 9, 10, 11*a*–11*d*, 12*a*–12*d*, 13 and 14 are block diagram flow charts of the software written to operate and control the central processing unit.

The software is embedded in EEPROMs 26, 28. Referring to FIG. 7, there is shown a block diagram flow chart for the primary computer program, or Main Program, for the apparatus for detection of overheated railroad wheel components. This Main Program is a free-running loop program, subject to servicing interrupts. After an interrupt routine has been completed, the program returns to the Main Program, which resumes execution at the point where it was interrupted.

I. THE MAIN PROGRAM. The Main Program is illustrated in outline form in FIG. 7 and includes the following routines.

A. The Main Program Control Routine. This routine starts the main program when a reset instruction is received from microcontroller 24.

B. The Initialize Program Memory Routine. This routine initializes RAM 32 to the states required for proper program control and flow.

C. The Initialize All Control Registers Routine. This routine initializes the control registers to permit processing of high speed inputs from optical switch 62 and wheel gates A (gate on) and B (gate off), which signal when a wheel enters the scanning zone and when a wheel leaves the scanning zone, respectively, on lines 58, 60 (see FIG. 1). In addition, this routine permits the Pulse Width Modulator (PWM), Timers, and External Interrupts to operate. The PWM is an integral internal part of microcontroller 24 that, under software command, controls the pulse width of the final analog output signal from D/A converter 29 on line 31.

D. The Initialize Interrupts Routine. This routine enables the Main Program to accept the interrupt routines. If the program gets lost or fails for any reason after it begins execution, a conventional watchdog timer (not shown) resets the program back to the starting address. After these three initialization routines have been performed, the Main Program begins execution of the primary Main Program loop, which includes: (1) Check Present State; (2) Check Serial Port; and (3) Monitor Transmit Buffer, augmented by the Service Interrupt Upon Request Routine, as discussed immediately below.

Figure 8A:
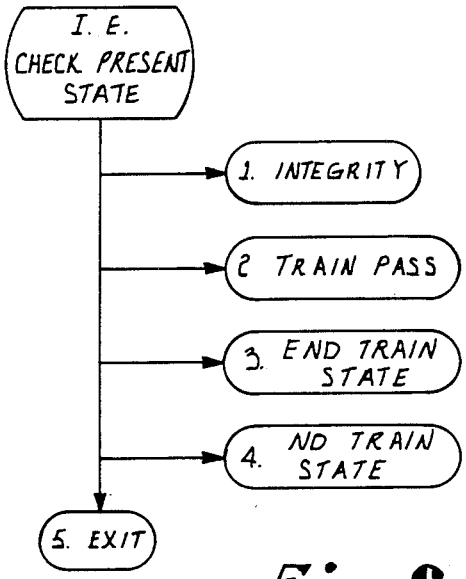

E. The Check Present State Routine. Referring to FIG. 8A, this routine determines which of the following states the apparatus is in: (1) integrity—the system is taking an integrity test to determine if it is operating properly; (2) train pass—the system is monitoring a passing train; (3) end train—the system has seen the end of a train; or (4) no train—the system is in an idle state because no train is present, in which case the routine (5) exits to the Main Program.

Figure 8B:
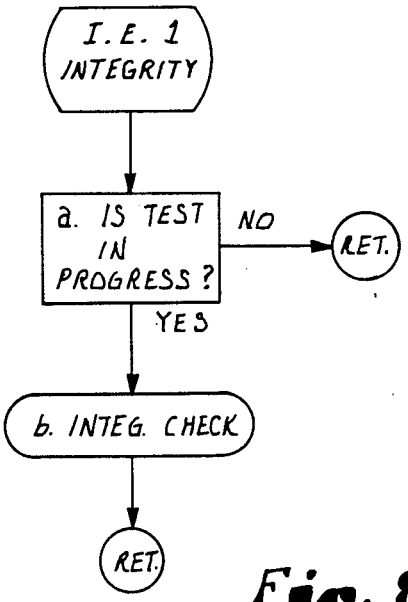

1. The Integrity Routine. Referring to FIG. 8B, the Integrity routine checks all circuits, memory locations, and so forth to determine whether the apparatus is working properly. If it is not, the Integrity Routine causes an integrity failure signal to be transmitted via leads 27 (digital), 31 (analog) to the remote signal processing equipment.

a. Is test in progress subroutine? This subroutine determines whether an integrity test is in progress, and if so, allows the test to continue. It no test is in progress, this subroutine returns the program to the Main Program.

b. Integrity Check Routine. This is a major subroutine that checks to ensure proper operation of the infrared scanning circuit, and is discussed in detail at section II, below. When an integrity check has been successfully completed, the program is returned to the Check Present State routine at the beginning of the Train Pass routine.

Figure 8C:
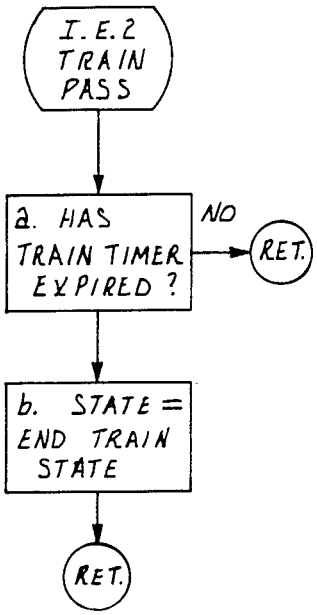

2. The Train Pass Routine. Referring to FIG. 8C, this routine responds to a signal from wheel gate A, which indicates that a train is passing, by turning on shutter motor 52 and enabling the temperature measurement circuits.

a. Has timer expired subroutine. When a train wheel leaves the scanning zone, as indicated by a signal from a wheel sensor at wheel gate B, this subroutine begins counting time. If more than ten seconds elapses before another wheel enters the scanning zone, this subroutine assumes that the last car of the train has passed and the program proceeds to the next subroutine. If, alternatively, another wheel enters the scanning zone within the ten second period, this subroutine returns the program to the Train Pass Routine, which allows continued temperature measurements to be taken.

b. State=end train state subroutine. This subroutine takes over when the "has timer expired subroutine" determines that the last car of the train has passed. This subroutine returns the program to the Check Present State Routine, which proceeds to the next subroutine.

Figure 8D:
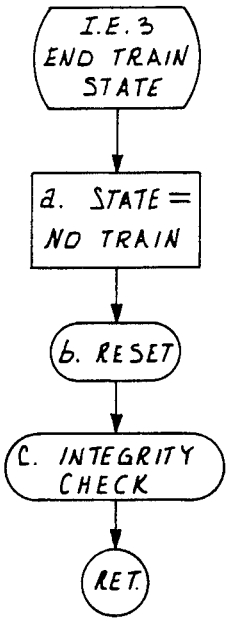

3. End Train State Subroutine. Referring to FIG. 8D, this routine is entered when the "State=end train state subroutine" is reached, and triggers the next subroutine.

a. State=no train subroutine. This subroutine sends the software back to the idle state and passes execution to the next subroutine.

b. Reset subroutine. This subroutine then resets all necessary memory locations for the next state by dumping all data accumulated during scanning of the train that has passed.

c. Integrity Check Routine. After a train has passed, an integrity check is performed (see "II," below) and the results of the integrity check are transmitted out the serial port on leads 27 (digital) 31 (analog). Then execution of the program is returned to the Check Present State routine.

Figure 8E:
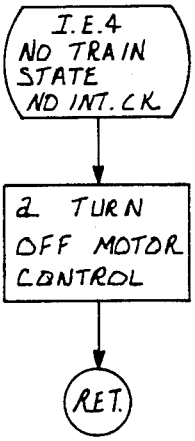
Figure 8F:
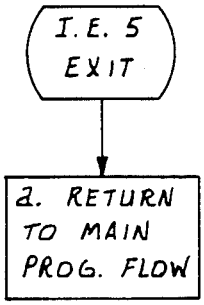

4. No Train State—No Integrity Check State Routine. Referring to FIG. 8E, this subroutine expresses the state of the software when no train is being scanned and no integrity check is being conducted.

a. Turn off motor control subroutine. This subroutine turns off shutter motor 52 and returns the program to the "Check Present State" routine.

5. Exit Routine. This routine returns control of the software to the Main Program, through the following subroutine.

a. Return to Main Program flow subroutine. This subroutine is addressed after all necessary subroutines of the "Check Present State" routine have been executed, and returns execution of the software to the Main Program.

F. Check Serial Port Routine. Referring again to FIG. 7, this routine checks to determine whether a message is being received through the serial port from the remote hot box detector. Usually, such messages alert the infrared scanning circuits that a train is approaching and initiate preparations for scanning the journal bearings. See "Train Coming Interrupt" routine, below.

G. Monitor Transmit Buffer Routine. Shown in FIG. 7, this routine monitors the transmit buffer, which is located in RAM 32 to determine whether the buffer contains a message that needs to be sent. If no message is present in the buffer, the Main Program continues. If a messages is present in the buffer, this routine ensures that it is transmitted, and continues to monitor the buffer until the buffer is empty, when this routine returns execution of the software to the Main Program.

H. Service Interrupt Upon Request. The circle in FIG. 7 does not illustrate an actual software routine. It is intended to show how interrupt service routines can interrupt the Main Program at any point. The interrupt service routines, which will be discussed in the listed order, include: (1) Integrity Check Routine; (2) Train Coming—Train Gone Routine; (3) High Speed Input Interrupt Routine; (4) External Interrupt Routine; and (5) D/A Conversion Interrupt Routine.

Figure 9:
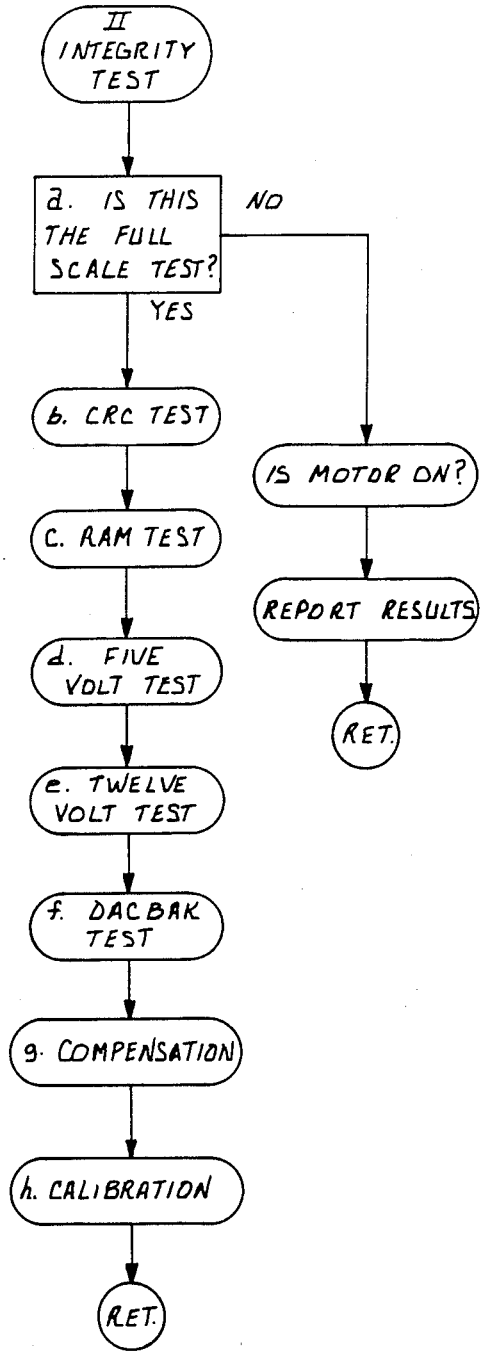

II. INTEGRITY TEST ROUTINE. Referring to FIG. 9, this routine performs two different integrity tests. The full-scale integrity test is a complete test of all electronic circuit elements, memory locations, and so forth, and is automatically performed every two minutes unless a train is approaching the scanning unit or is passing the scanning unit. The second integrity test is an abbreviated version, or short version integrity test, of the first integrity test. The short version is performed whenever a train is approaching the scanning unit. An important function of the short version integrity test is to report the results of the latest full-scale integrity test to the remote signal processing equipment.

If an error is found by any of the integrity routines and subroutines of the Integrity Test Routine, the program immediately goes to the "Report Results" subroutine, which transmits an integrity failure signal to the remote signal processing equipment.

A. The Is This The Full-Scale Integrity Test Routine. The Integrity Test Routine is invoked either (1) when two minutes have passed since the end of the previous full-scale integrity test and no train is present or approaching; or (2) when a train is approaching. The Is This The Full-Scale Integrity Test routine is not invoked until the Integrity Test Routine is underway.

The Is This The Full-Scale Integrity Test routine then determines whether the full-scale integrity test or the short version is in progress. If the full-scale integrity test is being performed, the software proceeds to the next routine in the full-scale integrity test.

If, however, a train is approaching, as indicated by a remote wheel sensor that transmits a signal to the infrared scanning unit on external interrupt line 57, the short version will be conducted. The short version consists of the "Is Motor On" routine and the "Report Results" routine.

The "Is Motor Running" routine determines whether shutter motor 52 is on, and, if not, turns it on. Then the "Report Results" subroutine is called, which transmits the results of the latest full-scale integrity test (which were stored in RAM) out serial port line 27 and analog line 31 to the remote signal processing unit. Then this subroutine returns execution of the software to the Main Program.

If the integrity test is a full-scale integrity test, routines B–H are invoked serially in the order listed below.

B. The Cyclical Redundancy Test Routine. This routine, in conjunction with conventional checksum tests (not shown), performs nondestructive tests on the values stored in selected memory locations. If the apparatus passes the CRC test, the software proceeds to the next routine.

C. The RAM Test Routine. This conventional routine performs a nondestructive test on selected low locations in the program stack, which is stored in RAM 32. It also preforms a destructive test on those RAM locations used to store temporary variables during scanning and those RAM locations used as transmit buffers.

D. The Five Volt Test Routine. This routine measures the five volt power supply output and determines whether that output is within tolerance. If so, the software proceeds to the next routine. If not, this routine issues an integrity failure signal that is transmitted to the remote signal processing equipment.

E. The Twelve Volt Test Routine. This routine measures the twelve volt power supply output and determines whether that output is within tolerance. If so, the software proceeds to the next routine.

F. The DACBAK Test Routine. "DacBak" is an abbreviation for "digital to analog converter feedback loop," that is, line 35 in FIG. 1. This routine writes specific known values into the pulse width modulator control circuits. Then it monitors the output of the pulse width modulator as measured on line 35 and determines whether the resulting output is within predetermined tolerances. If so, the software proceeds to the next routine.

G. The Compensation Routine. This routine automatically compensates for any difference between the internal temperature of housing 110 and the external ambient temperature. This routine is discussed below in detail.

H. The Calibration Routine. This routine automatically calibrates the output of digital gain control 20 to overcome the effects of pyroelectric cell signal drift over time and maintain the output of digital gain control 20 within design specifications. This routine is discussed in detail below. When this routine is completed, the program returns to the main program.

Figure 10:
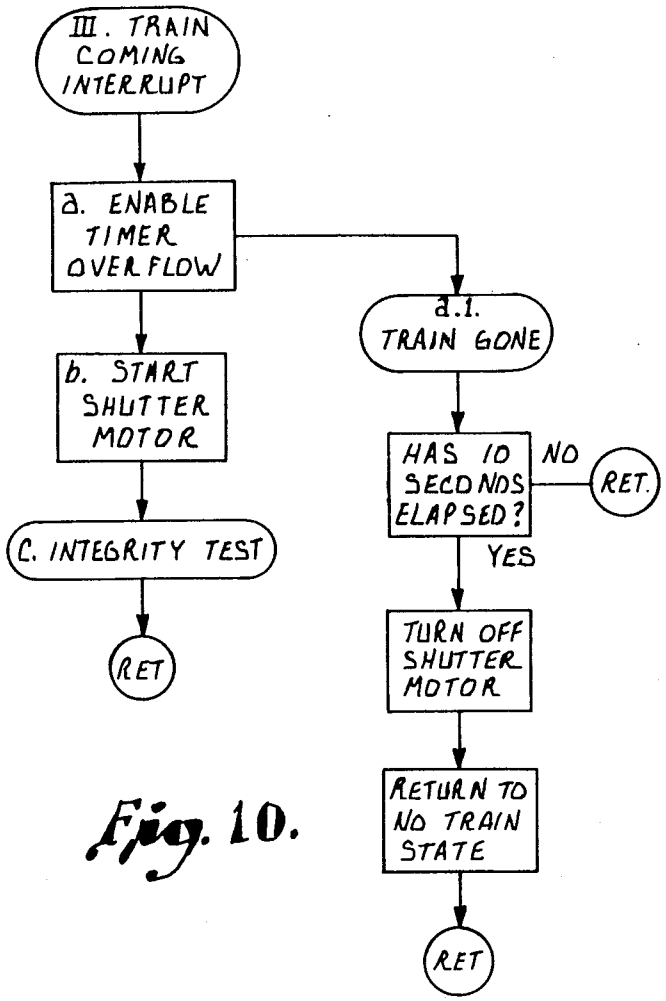

III. TRAIN COMING—TRAIN GONE INTERRUPT ROUTINE. Referring to FIG. 10, this routine is invoked when the remote signal processing equipment transmits a signal that a train is approaching the scanning zone (train approaching signal). The train-approaching signal is conventionally developed by a wheel sensor located on the tracks about 150 feet away from the scanning zone. It is received by the infrared scanning unit on external input line 57 (see FIG. 1). This routine prepares the infrared scanning unit for scanning a train.

A. The Enable Timer Overflow Routine. This instructional routine enables the Timer Overflow Interrupt routine.

1. The Timer Overflow Interrupt (Train Gone) Routine. This routine sets up and starts the software timer that signals the end of the train by assuming that if no new train wheel enters the scanning zone within ten seconds after a wheel has left the scanning zone, the end of the train has passed the scanning zone. This routine operates in conjunction with the "has timer expired" subroutine of the "Check Present State Routine," discussed above.

a. The have ten seconds elapsed subroutine. This subroutine monitors the condition of the software timer started by the previous routine. If ten seconds has not elapsed prior to resetting the timer in response to another train wheel entering the scanning zone, then this subroutine returns the software to the Main Program, where it continues monitoring the temperatures of passing wheel and axle components. When ten seconds has elapsed without another wheel entering the scanning zone, this subroutine invokes the "turn off shutter motor" subroutine, which shuts off the shutter motor, and causes the software to enter the "return to no train state" subroutine (see section I.E.4, "No Train State" subroutine of the Check Present State Routine, above). The "return to no train state" subroutine puts the software into an idle state and then returns control of the software to the main program.

B. The Start The Shutter Motor Routine. This routine starts shutter motor 52 when the approach of a train is signaled by the remote signal processing equipment so that it can be spinning at full speed when the train reaches the scanning zone.

C. The Integrity Test Routine. This routine is well described above. When invoked here, it performs a short version integrity check, which will be completed prior to the arrival of the train in the scanning zone. When the short version integrity test has been successfully completed, the software is returned to the Main Program.

Figure 11A:
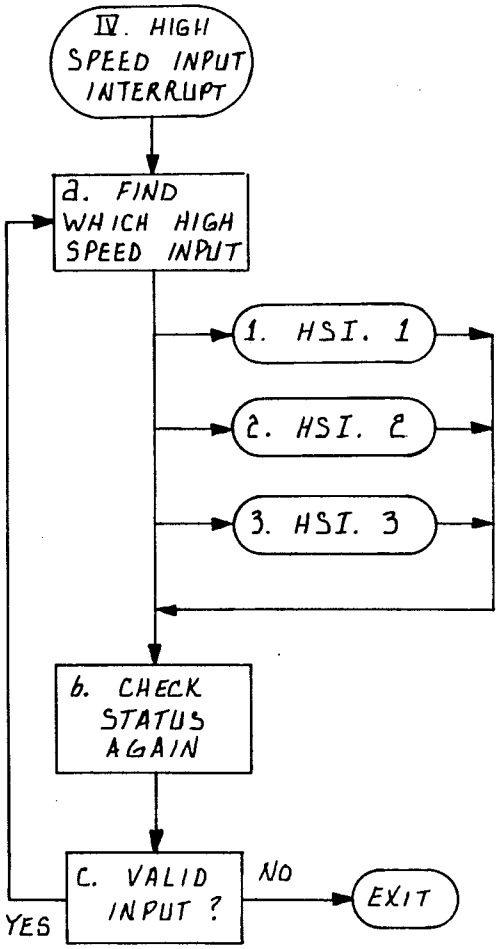

IV. HIGH SPEED INPUT INTERRUPT ROUTINE. Referring to FIG. 11A, this routine allows high speed events to interrupt execution of the software in order to monitor and process data regarding the temperature of the wheel components being scanned. A high speed input interrupt (HSI) can be generated by any one of the following three sources: (1) a wheel enters the scanning zone; (2) a wheel leaves the scanning zone; or (3) optical switch 62 is turned off by the passage of shutter 50 between LED 64 and phototransistor 66. These inputs are connected to the high speed input pins on microcontroller 24, which provide a faster response to input data than other input pins on microcontroller 24.

A. The Find Which HSI The Input Is Routine. This routine processes the incoming data to determine which of the three HSI listed above is causing the interrupt, and then causes the program to proceed to the appropriate subroutine, as listed immediately below.

Figure 11B:
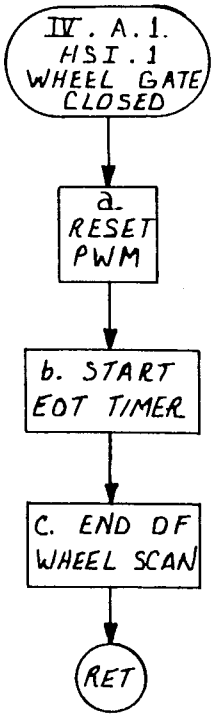

1. The HSI.1 (Wheel Leaving the Scanning Zone) Routine. Referring to FIG. 11B, this routine is initiated by the signal from the remote signal processing equipment that indicates a wheel has left the scanning zone. This routine then causes the infrared scanning unit to stop taking heat samples from pyroelectric cell 14 and preamp 16. It also causes the software to proceed to the next subroutine.

a. The reset PWM subroutine. The subroutine resets the pulse width modulator (PWM), which must be reset an the end of each wheel scan to ensure an accurate analog signal is transmitted from D/A converter 29.

b. The start EOT timer subroutine. This subroutine restarts the end of train timer to count down from a preset value until it times-out after ten seconds, or another wheel enters the scanning zone (see FIGS. 8, 10 and the related discussion for end of train timer uses).

c. The end of wheel scan subroutine. This subroutine sends a special ending byte to serial port lead 27 as soon as a wheel leaves the scanning zone. This ending byte is transmitted out the serial port to the remote signal processing equipment, signaling that no more data about that wheel will be transmitted. No corresponding signal is transmitted via analog output line 31. Conventional analog signal remote processing equipment does not require such a signal.

Figure 11C:
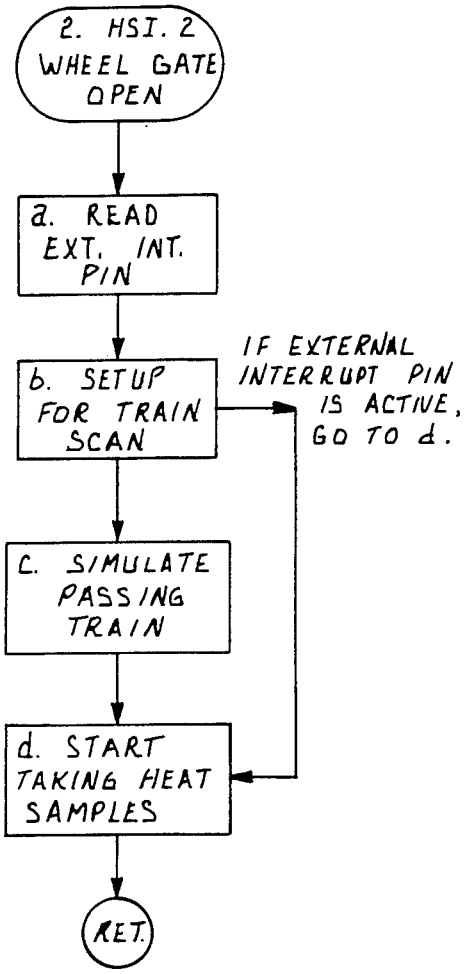
Figure 11D:
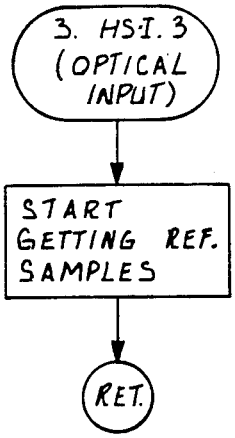

2. The HSI.2 (Wheel Entering the Scanning Zone) Routine. Referring to FIG. 11C, this routine is invoked whenever a wheel enters the scanning zone, which triggers a wheel sensor on the track that produces a signal ultimately received by the infrared scanning unit on external interrupt line 57 (see FIG. 1). This signal from the hot box detector instructs the infrared scanning unit to: (1) transmit the results of the most recent full-scale integrity test to the remote signal processing equipment, and (2) to begin sampling heat samples from the wheel that is in the scanning zone.

a. The read the external interrupt input pin subroutine. If this lead is active, the integrity test from the hot box detector is in progress.

b. The setup for train scan subroutine. This subroutine ensures that the initial values for certain variables used in processing heat samples from the passing wheel components are restored to their appropriate initial values prior to taking new heat samples. Further, if the "read the external interrupt input pin" subroutine, detects an active signal on the external interrupt input on line 57 (see FIG. 1), this subroutine forces the program to go to the "start taking heat samples" subroutine, skipping the "simulate passing train subroutine."

c. The simulate passing train subroutine. This subroutine turns the wheel gates on and off to simulate the passage of a train when no train is present, causing the shutter motor to be turned on and the scanning unit to process heat samples. This routine is invoked during actual field testing of the entire unit by trackside personnel who hold a heat source in front of lens 12 and check the output from the infrared scanning circuit. This subroutine is not used during normal operation of the infrared scanning unit. If a train is being scanned, this subroutine is skipped.

d. The start taking heat samples subroutine. This subroutine sets up the A/D converter in microcontroller 24, which starts taking heat samples from pyroelectric cell 14. These samples are processed by the A/D Conversion Interrupt routine, discussed below at section V. When no more train wheels are expected, that is, the end-of-train timer times-out, this subroutine returns the software to the Main Program.

3. The High Speed Input.3 (Optical Input) Routine. Referring to FIG. 4, this routine starts taking heat samples from depending shutter blades 54, 56 as they rotate between lens 12 and pyroelectric cell 14 to determine the reference temperature and ensure a change in the amount of infrared striking pyroelectric cell 14 over time. When no more train wheels are expected, that is, the end-of-train timer times-out, this subroutine returns the software to the Main Program.

V. INTERRUPT UPON A/D CONVERSION ROUTINE. This routine is called every time that an A/D conversion is completed. A/D conversion takes place in circuit hardware, under software command. Each analog signal that is converted to a digital signal is expressed as a two byte, sixteen bit number. The ten most significant digits of the sixteen bit number carry the information of the signal. The three least significant bits carry an identification tag, or channel number. The Interrupt Upon A/D Conversion Routine directs each digital signal to the appropriate software routine for further processing, using the three bit channel number to determine exactly where to send each digital signal.

Figure 12A:
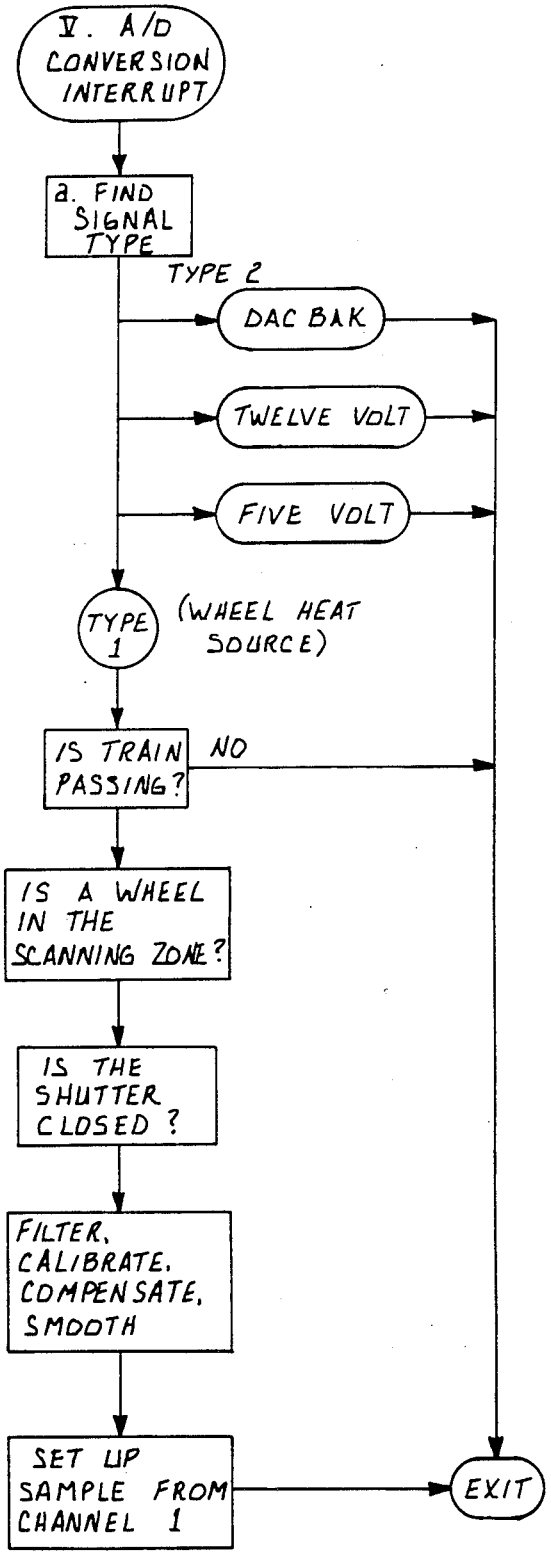

Referring to FIG. 12A, signals requiring distribution to various software routines are of two basic types, which are: type (1) internal testing and control data, for example, data required for integrity checks; and type (2) signals generated in the circuitry by the heat from a heat source that is being scanning in the scanning zone. If the value is of type (1), this routine passes the digital value to whatever routine needs it. If the value is a temperature measurement (type (2)), this routine determines whether a train scan is in progress, and, if so, processes the temperature scan value.

A. Find Signal Type. This routine reads the channel number of the signal and sends the signal to the channel having the same number.

1. The Process Type 1 Signals (heat samples) Routine. If the channel number identifies a signal as a temperature reading sample from pyroelectric cell 14 (channel 1), the signal passes through channel 1, and invokes the "Train Pass Routine" (see FIG. 8C) to answer the "Is Train Passing" subroutine. If not train is passing, the software goes to the "Exit" routine, and returns to the Main Program. If the answer is yes, the software proceeds to the next routine, "Is a wheel in the scanning zone." If no, the software "Exits," returning to the Main Program. If yes, the software proceeds to the next routine.

a. The Is the Shutter Closed Routine. This routine determines, in conjunction with optical switch 64, 66, whether the temperature reading is a reference temperature reading (shutter closed) or a wheel component reading. If it is a reference temperature, the reference temperature subroutine iterates an algorithm to determine the lowest temperature sample measured during the shutter-closed state and uses this value for the latest reference temperature. If one temperature sample is not lower than the preceding sample, a setup subroutine, discussed below, is invoked. After the reference temperature subroutine is completed, the software exits to the Main Program.

b. The Filter, Calibrate, Compensate, and Smooth Routine. Broadly speaking, this routine cleans up the signal developed from a heat reading of one wheel component and prepares it for transmission, largely by invoking specific parameters already developed by other systems of detector 10. If the shutter is open, the "is the shutter-closed routine" is skipped and the temperature signal is processed by this routine, which prepares a final output temperature signal for transmission from the digital to analog converter 29 or serial port digital lead set 27 to the remote detector circuitry.

The filter subroutine averages all the temperature samples for each individual wheel component.

Figure 12B:
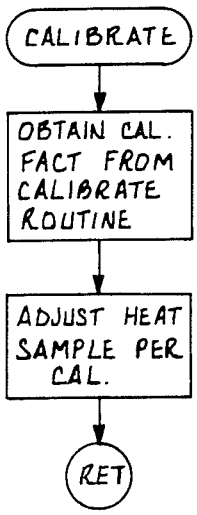

The calibrate subroutine, FIG. 12B, obtains the calibration factor from the Calibrate Routine, discussed in detail below, and adjusts the heat sample as required by the calibration factor by subtracting the reference temperature from the average temperature of each wheel component.

Figure 12C:
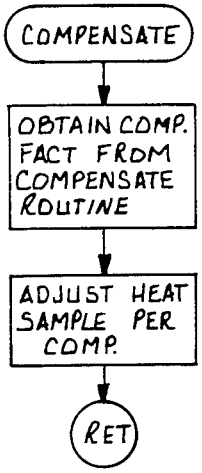
Figure 12D:
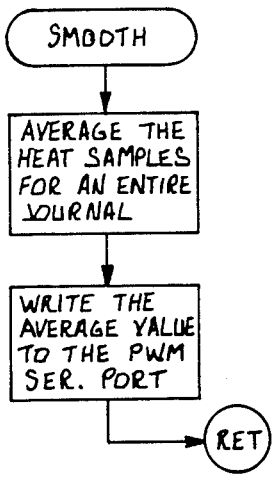

The Compensate subroutine, FIG. 12C, takes the result of the calibrate subroutine as its input, obtains the compensation factor from the Compensate Routine and then adjusts the heat sample as required by the compensation factor. The compensate routine compensates the signal representative of the heat sample for any difference between the internal temperature of housing 110 and the external ambient temperature.

The smoothing routine, FIG. 12C, is the last routine applied to the signal before it is output to the remote detection equipment via the pulse width modulator 29 or digital to analog converter 29 or the serial port on lead set 27. This routine averages the heat samples for an entire wheel component, and writes this average to the pulse width modulator 29 and the serial port on lead set 27.

c. The Setup Next Sample From Channel 1 Routine. This routine loads the analog to digital command register with the time (from a software timer) and the channel number of the next signal to be processed. This routine also loads the high speed output register of microcontroller 24 with instructions to perform the A/D conversion of the next sample after a predetermined period has expired. Then this routine "Exits," returning the software to the Main Program.

2. The Process Type 2 Signals Routine. This routine basically reads the channel number of an incoming signal and, if it is a type 2 signal, sends it to the software routine that needs that signal.

a. The DACBAK Signal Routine. If the signal is a DACBAK signal, this routine saves the values from the DACBAK Test Routine for use in integrity testing. When this routine is completed, it "Exits," returning the software to the Main Program.

b. The Twelve Volt Routine. This routine saves the values from the "Twelve Volt Test Routine" for use in integrity testing. When this routine is completed, it "Exits," returning the software to the Main Program.

c. The Five Volt Routine. This routine saves the values from the "Five Volt Test Routine" for use in integrity testing. When this routine is completed, it "Exits," returning the software to the Main Program.

Figure 13:
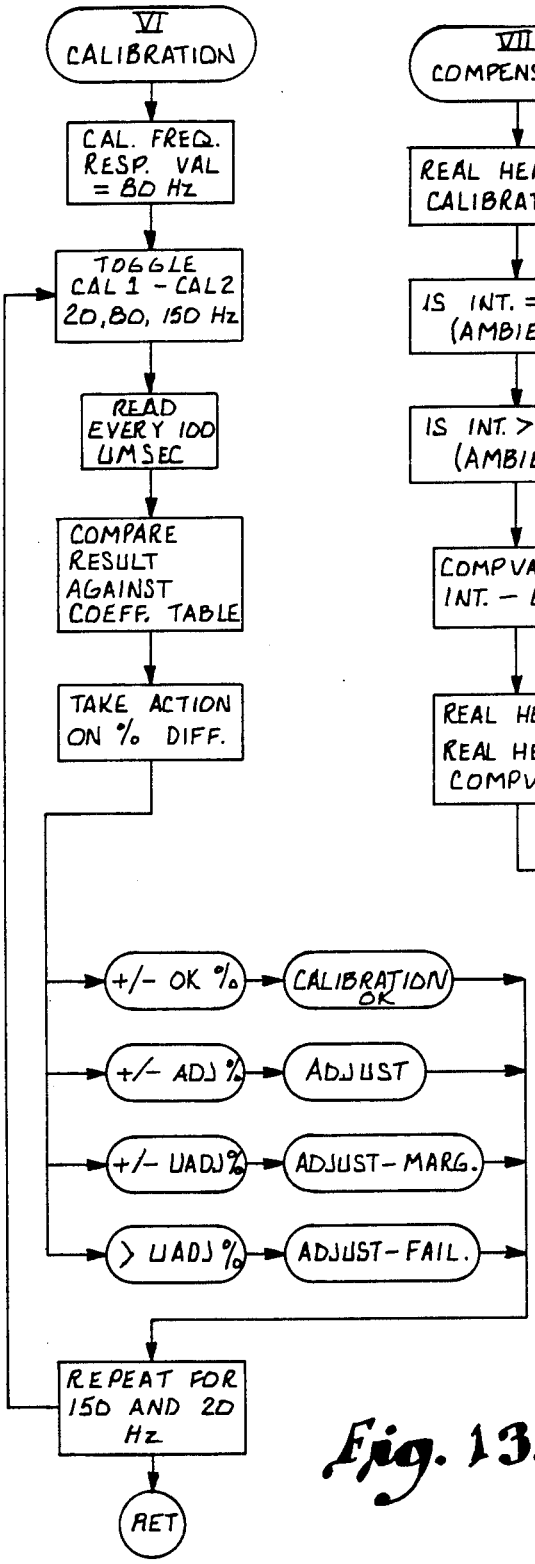

VI. CALIBRATION ROUTINE. Referring to FIG. 13, this routine insures that the output of digital gain control 20 is within specifications. If the output exceeds the preset high voltage or is less than the preset low voltage warning limits, and the calibration routine cannot bring the signal within specifications, the microcontroller 24 will adjust the gain to the maximum high or minimum low limit and issue an integrity failure. This ensures that the detector 10 will remain in calibration under all normal operating and aging conditions, and provides the end user with a diagnostic warning of marginal operation prior to actual failure. Each detector 10 is calibrated at the factory, a process that includes determining the temperature coefficients across the entire operating temperature range. The tables used for system calibration in the field, which are determined during factory calibration, are loaded into EEPROMs 26, 28 at the factory.

A. Toggle, Cal-1 - Cal-2 20, 80, 150 Hz. In operation, when microcontroller 24 determines that the shutter 50 is not blocking the transmission path from LED 74 to pyroelectric cell 14, microcontroller 24 initiates the input signals to the calibration circuit 76 that pulse the LED 74. When an LED 74 is stimulated it produces electromagnetic radiation that irradiates the pyroelectric cell 14, which generates an electrical signal representative of the intensity of the LED output relative to the ambient temperature within the housing 110. This output voltage returns to the microcontroller 24 for analysis. In this subroutine, the LED 74 is toggled between two known values, calibration value 1 (Cal-1) and calibration value 2 (Cal-2) at a rate of 80 Hz for calibration purposes and a rate of 20 Hz and 150 Hz to check frequency response and verify integrity.

B. Read Every 100 microseconds. This subroutine reads each output signal generated by Cal-1 and Cal-2, which are output every 100 microseconds. They are read ten times and these ten readings are averaged to obtain a more exact value.

C. Compare Result Against Coefficient Table. The difference between the output of digital gain control 20 for the Cal-1 and Cal-2 stimulation of LED 74 (the "difference signal") is established and is multiplied by the temperature coefficient for the then current temperature inside housing 110 as determined by the temperature sensor 70. The temperature coefficients are obtained from tables stored in EEPROMs 26, 28, as installed in the factory. The resulting value is converted into a percent of the difference between Cal-1 and Cal-2 outputs (the "calibration factor), and is applied to all heat signals read in from the pyroelectric cell 14 by addition or subtraction as described in the next paragraph.

This difference also accounts for the percent deviation in the energy emitted by the LED 74 under different conditions. The energy output of the LED for a given input energy level is a function of temperature. The LED has a known repeatable negative temperature coefficient for Radiant Intensity that is described by the constant 0.58%/degree C., with a 0% coefficient point at 49 degrees C. Accordingly, for temperatures below 49 degrees C., the program subtracts the LED correction factor, i.e. (0.58/degree C.)×(40 degrees C. −Ambient temperature), from the expected output energy of the LED, and for temperatures above 40 degrees C., the program adds 0.58%/degree C. This factor, called the LED error value, yields a relative intensity for the LED that is compared to a value that was stored at the time of factory calibration and a percent deviation from the expected energy output from the LED is determined, thus factoring out any error that changing energy outputs from the LED may otherwise contribute to the calibration loop.

The level of the signal from pyroelectric cell 14 when it is stimulated by infrared emitted by the LED is compared to an expected empirically derived value stored in an internal look up table. The stored value is a value for the temperature inside housing 110, as determined by the internal temperature sensor 70.

The percent deviations of the outputs of both the LED (LED error value) and the pyroelectric cell (detector error value) are added together to determine a composite error value, which is used by the "take action on % difference" subroutines described below. This composite error value represents the difference between an actual heat reading, or output signal, developed by the detector and the output signal that should have been developed to reflect accurately the heat sample produced by pulsing the LED.

D. Take Action on % Difference. This routine performs the required calibration and integrity reporting. The composite error value is a correction factor that may be combined with the heat sample signals developed by the pyroelectric cell in response to passing wheel components, to generate an accurate indication of wheel temperature, corrected for the effects of ambient temperature on both the LED and the pyroelectric cell. This correction factor, or difference signal, will be used to correct the signal developed from the pyroelectric cell according to the following schedule. Initially, the software determines the expected error in the pyroelectric cell signal due to ambient temperature (the difference signal) as a percent of the actual signal.

1. ±OK %. If the difference or expected error is within the acceptable tolerance (±2%), no adjustment is made. If, however, the difference is greater than ±2%, then microcontroller 24 turns on the shutter motor momentarily and rechecks the calibration routine to ensure that the shutter was not blocking the path between the LED and the pyroelectric cell.

2. ±Adj %. If the difference is within adjustable tolerance (still greater than ±2%, but less than ±7%), the output signal of pyroelectric cell 14 will be adjusted up or down by the calibration factor, bringing the signal into specifications.

3. ±UAdj %. If the difference is within the upper tolerance limit (greater than ±7%, but less than ±10%), the output signal of pyroelectric cell 14 will be adjusted up or down by the percentage of difference and the detector 10 will issue a marginal operational error signal to the remote signal processing equipment at the approach of the next train, but only if two consecutive calibration checks have produced this same failure.

4. Greater than UAdj %. If the difference is greater than the upper tolerance limit (greater than ±10%) the signal cannot be automatically calibrated to factory specifications, and this routine adjusts the output of pyroelectric cell 14 to bring the signal as close as possible to the proper adjustment and reports an integrity failure to the remote signal processing equipment upon the approach of the next train, but only if two consecutive calibration checks have produced this same failure.

E. Repeat for 150 and 20 Hz. This subroutine causes the program to return to the Toggle subroutine and repeat the "read every 100 microseconds" and "compare result against coeff. table" subroutines as illustrated in FIG. 13 for the toggle frequencies of 150 Hz and 20 Hz. A calibration factor is not, however, determined, nor is any adjustment made. They are toggled at rates of 20 Hz and 150 Hz to check frequency response and the results of this subroutine are reported in the integrity test results to the remote signal processing equipment.

VII. COMPENSATION ROUTINE. Data generated by the external, or ambient, temperature sensor 73 and the internal temperature sensor 70 (or internal ambient temperature) are compared in the CPU 24 so that an electrical signal of interest which is a function of temperature for any of various reasons, can be compensated to reduce or eliminate the effect of different ambient internal temperatures. The principles disclosed herein are useful whenever an electrical signal of interest is temperature dependent and it is desired to compensate that signal for the temperature difference between a first physical region of interest (typically having ambient temperature) and a second physical region of interest, such as the location of the circuitry for generating the electrical signal of interest. Naturally, it is not necessary that the external temperature sensor 73 be connected to the housing 110 circuitry by wires. Such remote temperature sensor could also be connected to the circuitry, e.g., CPU 24, by any indirect transmission means such as radio, microwave or light transmitters, which could allow for greater distances between the external temperature sensor 73 and the circuitry housing 110.

This routine automatically compensates for any difference between the temperature inside the housing 110 and the outdoor, or external, ambient temperature. The temperature signal developed by detector 10 for a wheel component reflects the temperature difference between the wheel component and the internal temperature of the housing. But it is the temperature difference between the wheel component and the outdoor ambient temperature that indicates whether a wheel component is overheated and a hot wheel component warning should be issued by the detector 10. Because the internal temperature of housing 110 may be quite different from the external ambient temperature, the detector must compensate for this temperature difference if it is to develop accurate hot wheel component warnings. This is the job of the automatic compensation routine. The internal temperature is used as a reference temperature to compare the wheel component against initially because the internal temperature provides the heat signal that impinges on the pyroelectric cell when the shutter is closed. A second reason for using the internal temperature is that the signal drift that is corrected by the compensation circuitry and software depends on the temperature of the circuitry inside the housing—not on the ambient temperature.

The shutter 50 is not used to provide any type of temperature reading, whether internal to the housing, or external to the housing. Instead, the purpose of the shutter is simply to provide the pyroelectric cell 14 with the difference in heat energy levels impinging on it that is required for it to develop a signal. The decision not to use a closed shutter signal from the pyroelectric cell as an indication of temperature required development of another measuring system to achieve reliable readings of the difference between wheel component temperature and ambient temperature.

The input of the compensation routine is the heat sample temperature signal developed by the calibration routine. This signal is then adjusted to reflect the difference between the internal housing temperature as measured by temperature sensor 70 and the external ambient temperature as measured by the remote temperature sensor 73 attached to lead 72 (FIG. 1). The remote temperature sensor 73 is deployed by the railroad workers where they believe it is most likely to be in a region of true ambient temperature, usually along the tracks. It may be fifty feet or more from housing 110.

The detector is designed to operate accurately in an outdoor ambient temperature range of from −45 degrees C. to +60 degrees C. and an internal housing temperature range of from −45 degrees C. to +85 degrees C. If the ambient temperature or internal temperature is outside these respective ranges, the detector issues an integrity failure signal. In addition, if the difference between the external and internal (EXT - INT) temperatures is less than −20 degrees C. or greater than 80 degrees C., the detector issues an integrity failure signal. Within these prescribed operating temperature ranges, however, the detector provides wheel component temperature signals with an accuracy of about ±1 degree C.

A. Real Heat from Calibration. This routine takes the temperature signal from the heat sample that was developed by the calibration routine, which becomes the input signal for the compensation operation.

B. Is Int=Ext (ambient). This routine determines whether the external ambient temperature is equal to the internal housing temperature, and if so, returns the program to the main program, without adjusting the temperature sample. If, however, the two temperatures are not equal, the program proceeds to the next subroutine.

C. Is Int Greater Than Ext (ambient). If the internal housing temperature is greater than the external ambient temperature, this subroutine proceeds to the "CompVal=Int−Ext" subroutine described in paragraph D below. If, however, the internal temperature is not greater than the external temperature, the program proceeds to the "CompVal=Ext−Int" subroutine described in paragraph E below. All temperature compensation values ultimately are reflected in adjustments to the voltage output of the pyroelectric cell 14. The output is adjusted at the linear rate of 18.8 mV/degree C. of the compensation value.

D. CompVal=Int−Ext. This subroutine calculates the compensation factor required when the internal temperature is greater than the external temperature, which is internal temperature minus external temperature. This compensation value (Compval) is added to the heat sample signal for an individual wheel component by the "RealHeat=Real Heat+CompVal" subroutine, and then the routine returns to the main program.

E. CompVal=Ext−Int. This subroutine is invoked if the internal temperature is not greater than the external temperature (establishing that the internal temperature is less than the external temperature, since the program already knows that these two temperatures are not equal). In this case, the compensation value is the external temperature minus the internal temperature, and this CompVal is subtracted from the heat sample signal for an individual wheel component by the "RealHeat=-RealHeat−CompVal" subroutine, and then the routine returns to the main program.

It is to be understood that while certain forms of this invention have been illustrated and described, it is not limited thereto, except in so far as such limitations are included in the following claims.

Having thus described the invention, what is claimed as new and desired to be secured by Letters Patent is:

1. A process for detecting an overheated component of a railroad train, comprising the steps of:

(a) at a trackside location, scanning a passing component with an infrared sensor during a scanning period;

(b) momentarily preventing any infrared radiation from said component from impinging on said infrared sensor during said scanning period to thereby establish a reference temperature;

(c) repeating said step (b) at successive time spacings each shorter in duration than said scanning period;

(d) comparing the response of said infrared sensor when infrared is received from the train component to the response of said infrared sensor at said time spacings; and (e) automatically and repeatedly calibrating the output of said infrared sensor when no train is present.

2. In an apparatus for detecting an overheated component of a railroad train:

(a) a sensing unit adapted to be disposed at trackside and having an infrared sensing element and means for focusing incident infrared radiation from a passing train component on said sensing element;

(b) a shutter movable between an open position and a closed position in which said shutter blocks radiation that would other wise reach said sensing element via said focusing means so that the sensing element is subjected only to ambient heat;

(c) means responsive to said infrared sensing element for producing a heat signal during a scanning period in which the sensing element is scanning the passing component;

(d) drive means connected to said shutter for repeatedly momentarily closing the same at successive time spacings each shorter in duration than said scanning period;

(e) output means responsive to said heat signal for comparing its amplitude between said time spacings with its amplitude at said time spacings; and (f) calibration means for automatically and repeatedly calibrating the output of said sensing element when the passing component is not present.

3. The apparatus as claimed in claim 2 wherein said calibration means further comprises:

(a) a light emitting diode (LED) within a housing for the apparatus;

(b) means for stimulating said LED at two different known levels;

(c) means for measuring the ambient temperature within said housing; and (d) means for adjusting the output of said sensing element to compensate for signal errors caused in the LED output and the sensing element output by the temperature.

4. A process for detecting an overheated component of a railroad train, comprising the steps of:

(a) at a trackside location, scanning a passing component with an infrared sensor during a scanning period;

(b) momentarily preventing any infrared radiation from said component from impinging on said infrared sensor during said scanning period to thereby establish a reference temperature;

(c) repeating said step (b) at successive time spacings each shorter in duration than said scanning period;

(d) comparing the response of said infrared sensor when infrared is received from the train component to the response of said infrared sensor at said time spacings; and (e) compensating the response of said infrared sensor for any temperature difference between said sensor and the ambient temperature.

5. The process claimed in claim 4 wherein step (e) further comprises:

(a) measuring the ambient temperature and producing an electrical signal representative of said ambient temperature;

(b) measuring the temperature in a second region of interest and producing a second electrical signal representative of said second temperature; and (c) compensating the response of said infrared sensor for any difference between said ambient and second region temperatures.

6. In an apparatus for detecting an overheated component of a railroad train:

(a) a sensing unit adapted to be disposed at trackside and having a sensing element responsive to electromagnetic radiation and means for focusing said radiation onto said sensing element;

(b) a shutter movable between an open position and a closed position in which said shutter blocks said radiation that would otherwise reach said sensing element via said focusing means;

(c) an external ambient temperature sensor connected to said sensing unit and remote therefrom;

(d) an internal temperature sensor connected to said sensing unit and located proximate to said sensing unit;

(e) means responsive to said sensing element for producing an electrical signal related to said radiation;

(f) means for driving said shutter for repeatedly opening and closing said shutter;

(g) means for comparing the amplitude of the signal generated by said sensing element while said shutter is closed with the signal generated by said sensing element when said shutter is open;

(h) means for compensating said sensing element signal to reflect any difference in said ambient temperature and the temperature of said sensing unit using data generated by said external temperature sensor and said proximate temperature sensor; and (i) a housing in which said sensing components are situated, except said external temperature sensor.

7. A method of detecting an overheated component of a railroad train, comprising the steps of:

(a) at a trackside location, scanning a passing component with an infrared sensor during a scanning period;

(b) momentarily preventing any infrared radiation from said component from impinging on said infrared sensor during said scanning period to thereby establish a reference temperature;

(c) repeating said step (b) at successive time spacings each shorter in duration than said scanning period;

(d) comparing the response of said infrared sensor when infrared is received from the train component to the response of said infrared sensor at said time spacings;

(e) automatically calibrating the output of said infrared sensor when no train is present; and (f) compensating the output of said infrared sensor for any temperature difference between said sensor and the ambient temperature.

8. In an apparatus for detecting an overheated component of a railroad train:

(a) a sensing unit adapted to be disposed at trackside and having a sensing element responsive to electromagnetic radiation and means for focusing said radiation onto said sensing element;

(b) a shutter movable between an open position and a closed position in which said shutter blocks said radiation that would otherwise reach said sensing element via said focusing means;

(c) an external ambient temperature sensor connected to said sensing unit and remote therefrom;

(d) an internal temperature sensor connected to said sensing unit and located proximate to said sensing unit;

(e) means responsive to said sensing element for producing an electrical signal related to said radiation;

(f) means for driving said shutter for repeatedly opening and closing said shutter;

(g) means for comparing the amplitude of the signal generated by said sensing element while said shutter is closed with the signal generated by said sensing element when said shutter is open;

(h) means for compensating said sensing element signal to reflect any difference in said ambient temperature and the temperature of said sensing unit using data generated by said external temperature sensor and said proximate temperature sensor;

(i) means for automatically calibrating the output of said sensing element; and (j) a housing in which said sensing components are situated, except for said external temperature sensor.

* * * * *

UNITED STATES PATENT AND TRADEMARK OFFICE

CERTIFICATE OF CORRECTION

PATENT NO. : 5,060,890

DATED : October 29, 1991

INVENTOR(S) : JEFFERY J. UTTERBACK and RANDALL S. MECCA

It is certified that error appears in the above—identified patent and that said Letters Patent is hereby corrected as shown below:

On the title page, item [75] Inventors:
Please correct the inventor's name to read JEFFERY J. UTTERBACK.

Column 16, line 56, after "(digital)" insert --,-- therein.

Claim 5, Column 27, line 61, after "second" insert --region-- therein.

Signed and Sealed this

Twenty-third Day of March, 1993

*Attest:*

STEPHEN G. KUNIN

*Attesting Officer*

*Acting Commissioner of Patents and Trademarks*